US011670218B2

(12) United States Patent
Kim et al.

(10) Patent No.: US 11,670,218 B2
(45) Date of Patent: Jun. 6, 2023

(54) DATA DRIVER AND DISPLAY DEVICE INCLUDING THE DATA DRIVER

(71) Applicant: Samsung Display Co., Ltd., Yongin-Si (KR)

(72) Inventors: Jiyoun Kim, Pohang-si (KR); Hongsoo Kim, Hwaseong-si (KR); Sehyuk Park, Seongnam-si (KR); Junheyung Jung, Yongin-si (KR); Manseung Cho, Seoul (KR)

(73) Assignee: Samsung Display Co., Ltd., Yongin-Si (KR)

( * ) Notice: Subject to any disclaimer, the term of this patent is extended or adjusted under 35 U.S.C. 154(b) by 0 days.

(21) Appl. No.: 17/518,617

(22) Filed: Nov. 4, 2021

(65) Prior Publication Data

US 2022/0293033 A1 Sep. 15, 2022

(30) Foreign Application Priority Data

Mar. 12, 2021 (KR) ..... 10-2021-0032742

(51) Int. Cl.
*G09G 3/20* (2006.01)

(52) U.S. Cl.
CPC ..... *G09G 3/2092* (2013.01); *G09G 2310/027* (2013.01); *G09G 2310/0286* (2013.01); *G09G 2310/0291* (2013.01)

(58) Field of Classification Search
CPC ..... G09G 3/2092; G09G 2310/027; G09G 2310/0286; G09G 2310/0291; G09G 3/2003; G09G 2300/0452; G09G 2310/0297; G09G 2320/0686; G09G 2370/08; G09G 3/3275; G09G 3/3225; G09G 3/3266; G09G 2300/0828
See application file for complete search history.

(56) References Cited

U.S. PATENT DOCUMENTS 9,916,806 B2 * 3/2018 Cho ..... G09G 3/3413
2007/0182756 A1 * 8/2007 Brown Elliott ..... G09G 5/02 345/613
2011/0148908 A1 * 6/2011 Jeong ..... G09G 5/02 345/590
2014/0139558 A1 * 5/2014 Tseng ..... G09G 3/3648 345/209
2015/0379947 A1 * 12/2015 Sang ..... G09G 3/3607 349/37
2016/0133178 A1 * 5/2016 Oh ..... G09G 3/2092 345/208

(Continued)

*Primary Examiner* — Jose R Soto Lopez
(74) *Attorney, Agent, or Firm* — Innovation Counsel LLP

(57) ABSTRACT

A data driver for providing data voltages to a display panel includes a digital-to-analog converting block, an option storing block, a data swap block and an output buffer block. The digital-to-analog converting block converts line data into the data voltages. The option storing block stores a pixel arrangement option representing a pixel arrangement structure of the display panel. The data swap block is connected to the digital-to-analog converting block and the option storing block, and selectively performs a data swap operation that swaps the data voltages based on the pixel arrangement option and whether the line data are odd line data or even line data. The output buffer block is connected to the data swap block and outputs the data voltages on which the data swap operation is selectively performed to data lines.

20 Claims, 15 Drawing Sheets

(56) References Cited

U.S. PATENT DOCUMENTS

| | | | | |
|---|---|---|---|---|
| 2016/0253781 | A1* | 9/2016 | Jin | G09G 3/2074 345/428 |
| 2016/0335948 | A1* | 11/2016 | Wen | G09G 5/06 |
| 2017/0256193 | A1* | 9/2017 | Zhou | G09G 3/2003 |
| 2018/0045983 | A1* | 2/2018 | Kim | G09G 3/20 |
| 2018/0122283 | A1* | 5/2018 | Kim | G09G 3/2074 |
| 2019/0139470 | A1* | 5/2019 | Yoo | H04N 13/344 |
| 2020/0135148 | A1* | 4/2020 | Bai | G09G 3/20 |
| 2020/0176531 | A1* | 6/2020 | Baek | H01L 27/3218 |
| 2021/0019103 | A1* | 1/2021 | Bai | G06F 3/1423 |
| 2021/0020135 | A1* | 1/2021 | Yang | G11C 7/1057 |
| 2021/0027751 | A1* | 1/2021 | Tang | G09G 3/3666 |
| 2021/0065625 | A1* | 3/2021 | Wang | G09G 3/2074 |
| 2021/0134242 | A1* | 5/2021 | Hei | G09G 3/2003 |
| 2021/0174724 | A1* | 6/2021 | Li | G09G 3/2003 |
| 2021/0201743 | A1* | 7/2021 | Park | G09G 3/2003 |
| 2021/0358379 | A1* | 11/2021 | Li | G09G 3/20 |
| 2021/0407369 | A1* | 12/2021 | Li | G09G 3/2074 |
| 2022/0037422 | A1* | 2/2022 | Zhang | H01L 27/326 |
| 2022/0059011 | A1* | 2/2022 | Li | G07F 17/34 |
| 2022/0068208 | A1* | 3/2022 | Kang | G09G 3/3258 |
| 2022/0068219 | A1* | 3/2022 | Yoo | G09G 3/3275 |

* cited by examiner

FIG. 2

| PIXEL ARRANGEMENT OPTION | PIXEL ARRANGEMENT |
|---|---|
| 0 | RGBG PENTILE ARRANGEMENT (ENTIRE DISPLAY REGION) |
| 1 | RGBG PENTILE ARRANGEMENT (CENTER REGION) + RGB STRIPE ARRANGEMENT (POD REGION) |

FIG. 5

220

| CHANNEL | CH1 | CH2 | CH3 | CH4 | ··· | CH4N+1 | CH4N+2 | CH4N+3 | CH4N+4 | ··· |
|---|---|---|---|---|---|---|---|---|---|---|
| ODD LDAT | RPD1 | GPD2 | BPD3 | GPD4 | ··· | RPD4N+1 | GPD4N+2 | BPD4N+3 | GPD4N+4 | ··· |
| VD@140 | RVD1 | GVD2 | BVD3 | GVD4 | ··· | RVD4N+1 | GVD4N+2 | BVD4N+3 | GVD4N+4 | ··· |
| 160 | NO DATA SWAP OPERATION | | | | | | | | | |
| VD@190 | RVD1 | GVD2 | BVD3 | GVD4 | ··· | RVD4N+1 | GVD4N+2 | BVD4N+3 | GVD4N+4 | ··· |

240

| CHANNEL | CH1 | CH2 | CH3 | CH4 | ··· | CH4N+1 | CH4N+2 | CH4N+3 | CH4N+4 | ··· |
|---|---|---|---|---|---|---|---|---|---|---|
| EVEN LDAT | RPD1 | GPD2 | BPD3 | GPD4 | ··· | RPD4N+1 | GPD4N+2 | BPD4N+3 | GPD4N+4 | ··· |
| VD@140 | RVD1 | GVD2 | BVD3 | GVD4 | ··· | RVD4N+1 | GVD4N+2 | BVD4N+3 | GVD4N+4 | ··· |
| 160 | DATA SWAP OPERATION | | | | | | | | | |
| VD@190 | BVD3 | GVD2 | RVD1 | GVD4 | ··· | BVD4N+3 | GVD4N+2 | RVD4N+1 | GVD4N+4 | ··· |

FIG. 8

320

| DISPLAY REGION | RGB STRIPE REGION | | | | | RGBG PENTILE REGION | | | | | RGB STRIPE REGION | | | | |
|---|---|---|---|---|---|---|---|---|---|---|---|---|---|---|---|
| CHANNEL | CH1 | CH2 | CH3 | CH4 | ··· | CHK+1 | CHK+2 | CHK+3 | CHK+4 | ··· | CHL+1 | CHL+2 | CHL+3 | CHL+4 | ··· |
| ODD LDAT | RPD1 | GPD2 | BPD3 | RPD4 | ··· | RPDK+1 | GPDK+2 | BPDK+3 | GPDK+4 | ··· | RPDL+1 | GPDL+2 | BPDL+3 | RPDL+4 | ··· |
| VD@140 | RVD1 | GVD2 | BVD3 | RVD4 | ··· | RVDK+1 | GVDK+2 | BVDK+3 | GVDK+4 | ··· | RVDL+1 | GVDL+2 | BVDL+3 | RVDL+4 | ··· |
| 160 | NO DATA SWAP OPERATION | | | | | | | | | | | | | | |
| VD@190 | RVD1 | GVD2 | BVD3 | RVD4 | ··· | RVDK+1 | GVDK+2 | BVDK+3 | GVDK+4 | ··· | RVDL+1 | GVDL+2 | BVDL+3 | RVDL+4 | ··· |

340

| DISPLAY REGION | RGB STRIPE REGION | | | | | RGBG PENTILE REGION | | | | | RGB STRIPE REGION | | | | |
|---|---|---|---|---|---|---|---|---|---|---|---|---|---|---|---|
| CHANNEL | CH1 | CH2 | CH3 | CH4 | ··· | CHK+1 | CHK+2 | CHK+3 | CHK+4 | ··· | CHL+1 | CHL+2 | CHL+3 | CHL+4 | ··· |
| ODD LDAT | RPD1 | GPD2 | BPD3 | RPD4 | ··· | RPDK+1 | GPDK+2 | BPDK+3 | GPDK+4 | ··· | RPDL+1 | GPDL+2 | BPDL+3 | RPDL+4 | ··· |
| VD@140 | RVD1 | GVD2 | BVD3 | RVD4 | ··· | RVDK+1 | GVDK+2 | BVDK+3 | GVDK+4 | ··· | RVDL+1 | GVDL+2 | BVDL+3 | RVDL+4 | ··· |
| 160 | NO DATA SWAP OPERATION | | | | | DATA SWAP OPERATION | | | | | NO DATA SWAP OPERATION | | | | |
| VD@190 | RVD1 | GVD2 | BVD3 | RVD4 | ··· | BVDK+3 | GVDK+2 | RVDK+1 | GVDK+4 | ··· | RVDL+1 | GVDL+2 | BVDL+3 | RVDL+4 | ··· |

FIG. 9

| PIXEL ARRANGEMENT OPTION | PIXEL ARRANGEMENT |
|---|---|
| 0 | RGBG PENTILE ARRANGEMENT (ENTIRE DISPLAY REGION) |
| 1 | RGBG PENTILE ARRANGEMENT (CENTER REGION)<br>+ RGB STRIPE ARRANGEMENT (POD REGION & CORNER REGION) |

FIG. 12

| PIXEL ARRANGEMENT OPTION | PIXEL ARRANGEMENT |
|---|---|
| 0 | RGBG PENTILE ARRANGEMENT (ENTIRE DISPLAY REGION) |
| 1 | RGBG PENTILE ARRANGEMENT (CENTER REGION) + RGB STRIPE ARRANGEMENT (POD REGION, FIRST NUMBER OF CHANNELS) |
| 2 | RGBG PENTILE ARRANGEMENT (CENTER REGION) + RGB STRIPE ARRANGEMENT (POD REGION, SECOND NUMBER OF CHANNELS) |
| 3 | RGBG PENTILE ARRANGEMENT (CENTER REGION) + RGB STRIPE ARRANGEMENT (POD REGION & CORNER REGION) |

DATA DRIVER AND DISPLAY DEVICE INCLUDING THE DATA DRIVER

CROSS-REFERENCE TO RELATED APPLICATION(S)

This application claims priority under 35 USC § 119 to Korean Patent Application No. 10-2021-0032742, filed on Mar. 12, 2021, in the Korean Intellectual Property Office (KIPO), the content of which is incorporated by reference herein in its entirety.

BACKGROUND

1. Field

Embodiments of the present inventive concept relate to a display device and more particularly to a data driver and a display device including the data driver.

2. Description of the Related Art

A data driver may be coupled to a display panel and may provide data voltages to pixels of the display panel through data lines of the display panel. The pixels of the display panel may display an image based on the data voltages received from the data driver.

The data driver should have a configuration and an operation suitable for a pixel arrangement structure of the display panel. Accordingly, dedicated data drivers respectively suitable for display panels having different pixel arrangement structures should be implemented.

SUMMARY

Some embodiments provide a data driver capable of driving display panels having different pixel arrangement structures.

Some embodiments provide a display device capable of driving display panels having different pixel arrangement structures.

Some embodiments provide a display device capable of driving a display panel including a first display region having a first pixel arrangement structure and a second display region having a second pixel arrangement structure.

According to embodiments, there is provided a data driver for providing data voltages to a display panel. The data driver includes a digital-to-analog converting block configured to convert line data into the data voltages, an option storing block configured to store a pixel arrangement option representing a pixel arrangement structure of the display panel, a data swap block connected to the digital-to-analog converting block and the option storing block, and configured to selectively perform a data swap operation that swaps the data voltages based on the pixel arrangement option and whether the line data are odd line data or even line data, and an output buffer block connected to the data swap block and configured to output the data voltages on which the data swap operation is selectively performed to data lines.

In embodiments, in a case where the pixel arrangement option has a first value, and the line data are the even line data, the data swap block may perform the data swap operation for an entire display region of the display panel. In a case where the pixel arrangement option has a second value, and the line data are the even line data, the data swap block may perform the data swap operation for a first display region of the display panel and may not perform the data swap operation for a second display region of the display panel.

In embodiments, the first display region may be an RGBG PENTILE™ region, and the second display region may be an RGB stripe region.

In embodiments, the first display region may be a center region disposed at a center of the display panel and the second display region may be a pixel on driver (POD) region disposed at both sides of the display panel.

In embodiments, the first display region may be a center region disposed at a center of the display panel and the second display region may include a pixel on driver (POD) region disposed at both sides of the display panel and a corner region disposed at four vertices of the display panel.

In embodiments, the data swap operation may be an even line data swap operation that swaps odd numbered data voltages adjacent each other in the even line data, where N is an integer greater than or equal to 0.

In embodiments, the data swap block may include a switch block disposed between the digital-to-analog converting block and the output buffer block, and a switch control block connected to the switch block and the option storing block, and configured to control the switch block based on the pixel arrangement option and whether the line data are the odd line data or the even line data.

In embodiments, the digital-to-analog converting block may include a plurality of digital-to-analog converters, the output buffer block may include a plurality of output buffers, and even numbered digital-to-analog converters of the plurality of digital-to-analog converters may be directly coupled to even numbered output buffers of the plurality of output buffers, respectively, where N is an integer greater than or equal to 0. The switch block may include first switches configured to respectively couple odd numbered digital-to-analog converters of the plurality of digital-to-analog converters to odd numbered output buffers of the plurality of output buffers in response to first switching signals, and second switches configured to couple each of the odd numbered digital-to-analog converters to an odd numbered output buffer disposed adjacent to a column in which the each of the odd numbered digital-to-analog converters are disposed in response to second switching signals.

In embodiments, in a case where the pixel arrangement option has a first value and the line data are the odd line data, the switch control block may provide the first switching signals to all of the first switches corresponding to an entire display region of the display panel. In a case where the pixel arrangement option has the first value, and the line data are the even line data, the switch control block may provide the second switching signals to all of the second switches corresponding to the entire display region of the display panel.

In embodiments, in a case where the pixel arrangement option has a second value and the line data are the odd line data, the switch control block may provide the first switching signals to all of the first switches corresponding to an entire display region of the display panel. In a case where the pixel arrangement option has the second value, and the line data are the even line data, the switch control block may provide the second switching signals to a portion of the second switches corresponding to a first display region of the display panel and may provide the first switching signals to a portion of the first switches corresponding to a second display region of the display panel.

In embodiments, the pixel arrangement option may have two or more bits to represent one of three or more pixel arrangement structures.

In embodiments, the pixel arrangement option having a first value may represent that an entire display region of the display panel is an RGBG PENTILE™ region. The pixel arrangement option having a second value may represent that a first center region disposed at a center of the display panel is the RGBG PENTILE™ region and a first POD region disposed at both sides of the display panel and corresponding to a first number of data channels is an RGB stripe region. The pixel arrangement option having a third value may represent that a second center region disposed at the center of the display panel is the RGBG PENTILE™ region and a second POD region disposed at the both sides of the display panel and corresponding to a second number of data channels is the RGB stripe region. The pixel arrangement option having a fourth value may represent that a third center region disposed at the center of the display panel is the RGBG PENTILE™ region and a third POD region disposed at the both sides of the display panel and a corner region disposed at four corners of the display panel is the RGB stripe region.

In embodiments, the data driver may further include a shift register configured to sequentially generate sampling signals, a sampling latch block configured to sequentially store the line data in response to the sampling signals, and a holding latch block configured to receive the line data from the sampling latch block in response to a load signal and to provide the line data to the digital-to-analog converting block.

According to embodiments, there is provided a display device including a display panel, a scan driver configured to provide scan signals to the display panel, a data driver configured to provide data voltages to the display panel, and a controller configured to control the scan driver and the data driver. The data driver includes a digital-to-analog converting block configured to convert line data into the data voltages, an option storing block configured to store a pixel arrangement option representing a pixel arrangement structure of the display panel, a data swap block connected to the digital-to-analog converting block and the option storing block, and configured to selectively perform a data swap operation that swaps the data voltages based on the pixel arrangement option and whether the line data are odd line data or even line data, and an output buffer block connected to the data swap block and configured to output the data voltages on which the data swap operation is selectively performed to data lines.

In embodiments, in a case where the pixel arrangement option has a first value and the line data are the even line data, the data swap block may perform the data swap operation for an entire display region of the display panel. In a case where the pixel arrangement option has a second value, and the line data are the even line data, the data swap block may perform the data swap operation for a first display region of the display panel and may not perform the data swap operation for a second display region of the display panel.

According to embodiments, there is provided a display device including a display panel including a first display region in which first pixels are arranged in a first pixel arrangement structure and a second display region in which second pixels are arranged in a second pixel arrangement structure different from the first pixel arrangement structure, a scan driver configured to provide scan signals to the display panel, a data driver configured to provide data voltages to the display panel, and a controller configured to control the scan driver and the data driver. The data driver performs a data swap operation that swaps the data voltages for the first display region, and does not perform the data swap operation for the second display region.

In embodiments, the first display region may be an RGBG PENTILE™ region, and the second display region may be an RGB stripe region.

In embodiments, the first display region may be a center region disposed at a center of the display panel and the second display region may be a pixel on driver (POD) region disposed at both sides of the display panel.

In embodiments, the first display region may be a center region disposed at a center of the display panel and the second display region may include a pixel on driver (POD) region disposed at both sides of the display panel and a corner region disposed at four corners of the display panel.

In embodiments, the data swap operation may be an even line data swap operation that swaps the data voltage at a (4N+1)-th data channel and the data voltage at a (4N+3)-th data channel with each other among the data voltages corresponding to even line data, where N is an integer greater than or equal to 0.

According to embodiments, there is provided a data driver for providing data voltages to d display panel which includes a plurality of columns. The data driver includes a digital-to-analog converting block including a plurality of digital-to-analog converters each disposed in a column, respectively, an option storing block configured to store a pixel arrangement option representing a pixel arrangement structure of the display panel, a data swap block connected to the digital-to-analog converting block and the option storing block, and an output buffer block connected to the data swap block and configured to output the data voltages, the output buffer block including a plurality of output buffers each disposed in a respective column. The data swap block may include a plurality of first switches respectively connecting the plurality of digital-to-analog converters to the plurality of output buffers, each of the plurality of first switches connecting a digital-to-analog converter to an output buffer disposed in a same column, and a plurality of second switches respectively connecting digital-to-analog converters disposed in one of odd columns or even columns to output buffers disposed in the one of odd columns or even columns, each of the plurality of second switches connecting one digital-to-analog converter in one column to one output buffer disposed in one column different from the column to which the one digital-to-analog converter is connected.

In embodiments, the each of the plurality of second switches may connect one digital-to-analog converter in one even column to one output buffer disposed in another even column.

In embodiments, the each of the plurality of second switches may connect the one digital-to-analog converter in the one even column to the one output buffer disposed in an even column disposed adjacent the one even column.

In embodiments, the each of the plurality of second switches may connect one digital-to-analog converter in one odd column to one output buffer disposed in another odd column.

In embodiments, the each of the plurality of second switches may connect the one digital-to-analog converter in the one odd column to the one output buffer disposed in an odd column disposed adjacent the one odd column.

As described above, in a data driver and a display device according to embodiments, an option storing block may store a pixel arrangement option representing a pixel arrangement structure of a display panel, and a data swap block may selectively perform a data swap operation that swaps data voltages according to the pixel arrangement option. Thus, the data driver according to embodiments may drive various display panels having different pixel arrangement structures, in particular including a hybrid display panel having both of an RGBG PENTILE™ pixel arrangement structure and an RGB stripe pixel arrangement structure.

Further, in a display device according to embodiments, a display panel may include a first display region in which first pixels are arranged in a first pixel arrangement structure (e.g., the RGBG PENTILE™ pixel arrangement structure), and a second display region in which second pixels are arranged in a second pixel arrangement structure (e.g., the RGB stripe pixel arrangement structure), and a data driver may perform a data swap operation that swaps data voltages for the first display region, and may not perform the data swap operation for the second display region. Accordingly, the data driver may drive the hybrid display panel having both of the RGBG PENTILE™ pixel arrangement structure and the RGB stripe pixel arrangement structure.

BRIEF DESCRIPTION OF THE DRAWINGS

Illustrative, non-limiting embodiments will be more clearly understood from the following detailed description in conjunction with the accompanying drawings.

FIG. 2 is a diagram for describing an example of a pixel arrangement option according to embodiments.

FIG. 5 is a diagram for describing an example of a data swap operation performed by a data driver that drives an RGBG PENTILE™ display panel of FIG. 3.

FIG. 8 is a diagram for describing an example of a data swap operation performed by a data driver that drives a hybrid display panel of FIG. 6.

FIG. 9 is a diagram for describing another example of a pixel arrangement option according to embodiments.

FIG. 12 is a diagram for describing still another example of a pixel arrangement option according to embodiments.

DESCRIPTION OF EMBODIMENTS

Figure 1:
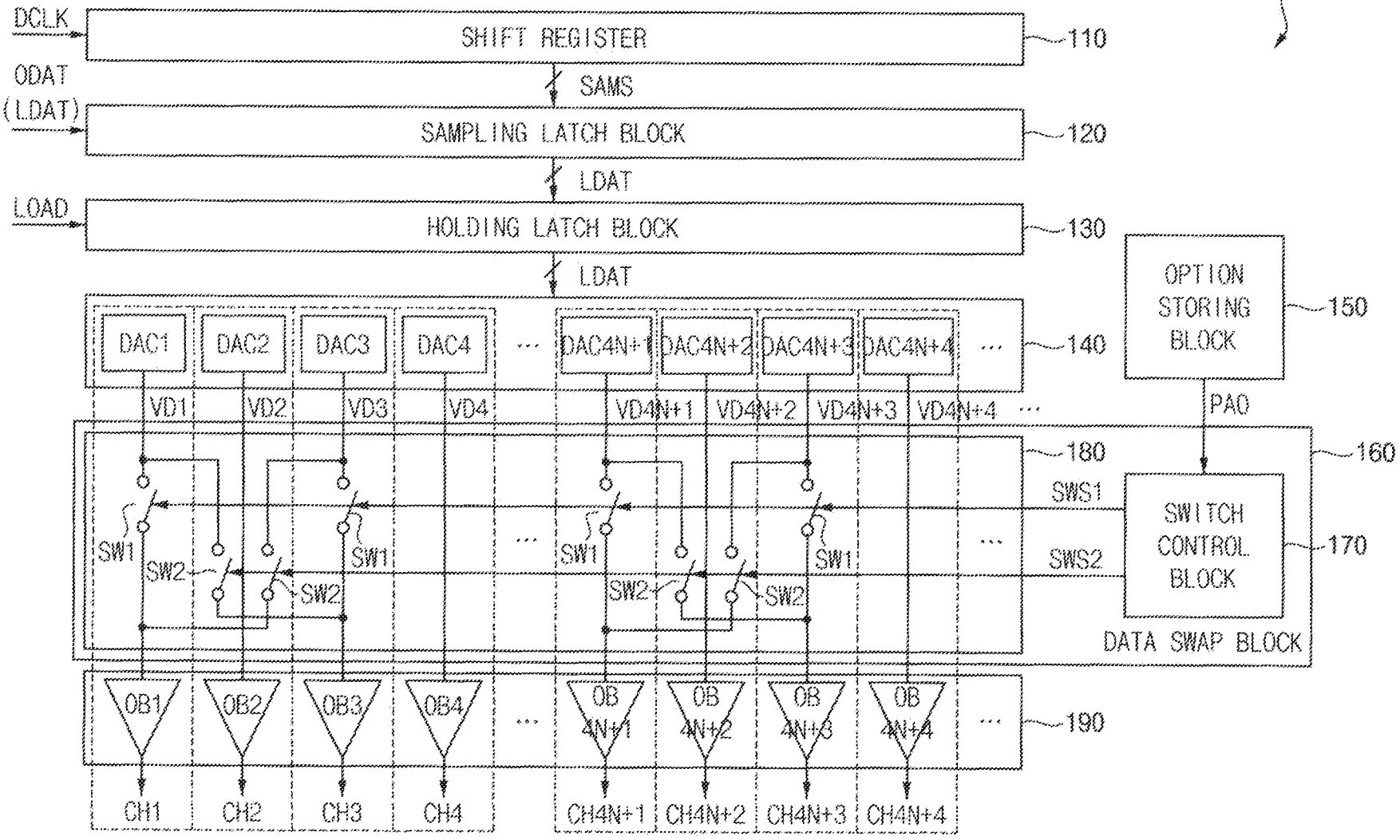
FIG. 1 is a block diagram illustrating a data driver according to embodiments.

The embodiments are described more fully hereinafter with reference to the accompanying drawings. Like or similar reference numerals refer to like or similar elements throughout.

FIG. 1 is a block diagram illustrating a data driver according to embodiments.

Referring to FIG. 1, a data driver 100 providing data voltages (VD1, VD2, VD3, VD4, . . . , VD4N+1, VD4N+2, VD4N+3, VD4N+4, . . . ) to a display panel according to embodiments may include a digital-to-analog converting block 140, an option storing block 150, a data swap block 160 and an output buffer block 190. In some embodiments, the data driver 100 may further include a shift register 110, a sampling latch block 120 and a holding latch block 130.

The shift register 110 may sequentially generate sampling signals SAMS in response to a data clock signal DCLK. In some embodiments, the shift register 110 may include a plurality of flip-flops connected in series to sequentially generate the sampling signals SAMS.

The sampling latch block 120 may sequentially store output image data ODAT or line data LDAT for each pixel line (or each pixel row) received from a controller in response to the sampling signals SAMS from the shift register 110. In some embodiments, the sampling latch block 120 may include a plurality of sampling latches that respectively samples pixel data included in the line data LDAT in response to the sampling signals SAMS.

The holding latch block 130 may receive and store the line data LDAT received from the sampling latch block 120 in response to a load signal LOAD received from the controller and may provide the line data LDAT to the digital-to-analog converting block 140. In some embodiments, the holding latch block 130 may include a plurality of holding latches respectively corresponding to the plurality of sampling latches of the sampling latch block 120.

The digital-to-analog converting block 140 may convert the line data LDAT received from the holding latch block 130 into the data voltages (VD1, VD2, VD3, VD4, . . . , VD4N+1, VD4N+2, VD4N+3, VD4N+4, . . . ) that are analog voltages. In some embodiments, as illustrated in FIG. 1, the digital-to-analog converting block 140 may include a plurality of digital-to-analog converters (DAC1, DAC2, DAC3, DAC4, . . . , DAC4N+1, DAC4N+2, DAC4N+3, DAC4N+4, . . . ) respectively corresponding to the plurality of holding latches of the holding latch block 130.

The output buffer block 190 may output the data voltages (VD1, VD2, VD3, VD4, . . . , VD4N+1, VD4N+2, VD4N+3, VD4N+4, . . . ) converted by the digital-to-analog converting block 140 to data lines, respectively. In some embodiments, the output buffer block 190 may output the data voltages (VD1, VD2, VD3, VD4, . . . , VD4N+1, VD4N+2, VD4N+3, VD4N+4, . . . ) on which a data swap operation is selectively performed. In some embodiments, as illustrated in FIG. 1, the output buffer block 190 may include a plurality of output buffers (OB1, OB2, OB3, OB4, . . . , OB4N+1, OB4N+2, OB4N+3, OB4N+4, . . . ) connected to a plurality of data channels (CH1, CH2, CH3, CH4, . . . , CH4N+1, CH4N+2, CH4N+3, CH4N+4, . . . ), respectively.

The option storing block 150 may store a pixel arrangement option PAO representing a pixel arrangement structure of the display panel driven by the data driver 100. In some embodiments, when a display device including the data driver 100 is manufactured, the pixel arrangement option PAO may be stored to the option storing block 150. In this case, the option storing block 150 may be implemented with a nonvolatile memory to retain the stored pixel arrangement option PAO even after the data driver 100 is not supplied with power. In other embodiments, the option storing block 150 may be implemented with a volatile memory or a register and the pixel arrangement option PAO may be stored in an external nonvolatile memory disposed outside the data driver 100 when the display device is manufactured. The option storing block 150 may receive the pixel arrangement option PAO through the controller from the external nonvolatile memory during a power-on of the display device and store the pixel arrangement option PAO in the option storing block 150 that is included in the data driver 100.

The pixel arrangement option PAO may represent one of different pixel arrangement structures of various display panels. In some embodiments, as illustrated in FIG. 2, the pixel arrangement option PAO having a first value (e.g., '0') may represent that an entire display region of a display panel is an RGBG PENTILE™ region in which pixels are arranged in an RGBG PENTILE™ pixel arrangement structure and the pixel arrangement option PAO having a second value (e.g., '1') may represent that a first region of a display panel is the RGBG PENTILE™ region and a second region of the display panel is an RGB stripe region in which pixels are arranged in an RGB stripe pixel arrangement structure. In other embodiments, as illustrated in FIG. 9, the pixel arrangement option PAO having the first value (e.g., '0') may represent that an entire display region of a display panel is the RGBG PENTILE™ region, and the pixel arrangement option PAO having the second value (e.g., '1') may represent that a center region of a display panel is the RGBG PENTILE™ region and a pixel on driver (POD) region PODR and a corner region of the display panel are the RGB stripe regions. In still other embodiments, as illustrated in FIG. 12, the pixel arrangement option PAO may have two or more bits to represent one of three or more pixel arrangement structures. Although FIGS. 2, 9 and 12 illustrate examples of the pixel arrangement option PAO, the pixel arrangement option PAO according to embodiments is not limited to the examples of FIGS. 2, 9 and 12.

The data swap block 160 may selectively perform a data swap operation that swaps the data voltages (VD1, VD2, VD3, VD4, . . . , VD4N+1, VD4N+2, VD4N+3, VD4N+4, . . . ) based on the pixel arrangement option PAO and whether the line data LDAT are odd line data for an odd-numbered pixel line (or an odd-numbered pixel row) of the display panel or even line data for an even-numbered pixel line (or an even-numbered pixel row) of the display panel. In some embodiments, in a case where the pixel arrangement option PAO has a first value (e.g., '0') and the line data LDAT are the even line data, the data swap block 160 may perform the data swap operation for an entire display region of the display panel. Further, in a case where the pixel arrangement option PAO has a second value (e.g., '1') and the line data LDAT are the even line data, the data swap block 160 may perform the data swap operation for a first display region of the display panel and may not perform the data swap operation for a second display region of the display panel. For example, the first display region may be RGBG PENTILE™ region and the second display region may be the RGB stripe region. The data swap block 160 may perform the data swap operation for the RGBG PENTILE™ region and may not perform the data swap operation for the RGB stripe region. Further, in some embodiments, the data swap operation may be an even line data swap operation (or an even line RB data swap operation) that swaps the data voltages of (4N+1)-th data channels (CH1, CH5, . . . , CH4N+1, . . . ) with the data voltages of (4N+3)-th data channels (CH3, CH7, . . . , CH4N+3, . . . ) among the data voltages (VD1, VD2, VD3, VD4, . . . , VD4N+1, VD4N+2, VD4N+3, VD4N+4, . . . ) corresponding to the even line data, where N is an integer greater than or equal to 0.

To perform these operations, the data swap block 160 may include a switch control block 170 that generates first and second switching signals SWS1 and SWS2 based on the pixel arrangement option PAO stored in the option storing block 150 and/or whether the line data LDAT are the odd line data or the even line data, and a switch block 180 that operates in response to the first and second switching signals SWS1 and SWS2.

The switch block 180 may be disposed between the digital-to-analog converting block 140 and the output buffer block 190. In some embodiments, as illustrated in FIG. 1, the digital-to-analog converting block 140 may include the plurality of digital-to-analog converters (DAC1, DAC2, DAC3, DAC4, . . . , DAC4N+1, DAC4N+2, DAC4N+3, DAC4N+4, . . . ) and the output buffer block 190 may include the plurality of output buffers (OB1, OB2, OB3, OB4, . . . , OB4N+1, OB4N+2, OB4N+3, OB4N+4, . . . ). Even numbered digital-to-analog converters (DAC2, DAC4, . . . , DAC4N+2, DAC4N+4, . . . ) may be directly coupled to even numbered output buffers (OB2, OB4, . . . , OB4N+2, OB4N+4, . . . ) at even numbered data channels (CH2, CH4, . . . , CH4N+2, CH4N+4, . . . ), respectively, where N is an integer greater than or equal to 0. Further, the switch block 180 may include first switches SW1 that respectively couple odd numbered digital-to-analog converters (DAC1, DAC3, . . . , DAC4N+1, DAC4N+3, . . . ) to odd numbered output buffers (OB1, OB3, . . . , OB4N+1, OB4N+3, . . . ), respectively, in response to the first switching signals SWS1, and second switches SW2 that couple the (4N+1)-th digital-to-analog converters (DAC1, . . . , DAC4N+1, . . . ) to the (4N+3)-th output buffers (OB3, . . . , OB4N+3, . . . ), respectively, and the (4N+3)-th digital-to-analog converters (DAC3, . . . , DAC4N+3, . . . ) to the (4N+1)-th output buffers (OB1, . . . , OB4N+1, . . . ), respectively, in response to the second switching signals SWS2. Thus, in a case where the first switching signals SWS1 are applied to the switch block 180, the odd numbered digital-to-analog converters (DAC1, DAC3, . . . , DAC4N+1, DAC4N+3, . . . ) may be respectively coupled to the odd numbered output buffers (OB1, OB3, . . . , OB4N+1, OB4N+3, . . . ) at odd numbered data channels (CH1, CH3, . . . , CH4N+1, CH4N+3, . . . ). Further, in a case where the second switching signals SWS2 are applied to the switch block 180, the (4N+1)-th digital-to-analog converters (DAC1, . . . , DAC4N+1, . . . ) at the (4N+1)-th data channels (CH1, . . . , CH4N+1, . . . ) may be coupled to the (4N+3)-th output buffers (OB3, . . . , OB4N+3, . . . ) at the (4N+3)-th data channels (CH3, . . . , CH4N+3, . . . ), and the (4N+3)-th digital-to-analog converters (DAC3, . . . , DAC4N+3, . . . ) at the (4N+3)-th data channels (CH3, . . . , CH4N+3, . . . ) may be coupled to the (4N+1)-th output buffers (OB1, . . . , OB4N+1, . . . ) at the (4N+1)-th data channels (CH1, . . . , CH4N+1, . . . ), respectively.

The switch control block 170 may control the switch block 180 based on the pixel arrangement option PAO stored in the option storing block 150 and/or whether the line data LDAT are the odd line data or the even line data. The switch control block 170 may output one of the first switching signal SWS1 and the second switching signal SWS2 to the switch block 180.

In some embodiments, the switch control block 170 may provide the first switching signals SWS1 to all of the first switches SW1 corresponding to the entire display region of the display panel in a case where the pixel arrangement option PAO has a first value (e.g., '0') and the line data LDAT are the odd line data, and may provide the second switching signals SWS2 to all of the second switches SW2 corresponding to the entire display region of the display panel in a case where the pixel arrangement option PAO has the first value (e.g., '0'), and the line data LDAT are the even line data. For example, the pixel arrangement option PAO having the first value (e.g., '0'), may represent that the entire display region is the RGBG PENTILE™ region or that the display panel is an RGBG PENTILE™ display panel, and the switch control block 170 may provide the first switching signals SWS1 to all of the first switches SW1 while the odd line data for the RGBG PENTILE™ display panel are received and may provide the second switching signals SWS2 to all of the second switches SW2 while the even line data for the RGBG PENTILE™ display panel are received. Thus, while the odd line data for the RGBG PENTILE™ display panel are received, the odd numbered digital-to-analog converters (DAC1, DAC3, . . . , DAC4N+1, DAC4N+3, . . . ) may be respectively coupled to the odd numbered output buffers (OB1, OB3, . . . , OB4N+1, OB4N+3, . . . ) through the first switches SW1, odd numbered data voltages (VD1, VD3, . . . , VD4N+1, VD4N+3, . . . ) may be respectively output at the odd numbered data channels (CH1, CH3, . . . , CH4N+1, CH4N+3, . . . ), and the data swap operation may not be performed. Further, while the even line data for the RGBG PENTILE™ display panel are received, the (4N+1)-th digital-to-analog converters (DAC1, . . . , DAC4N+1, . . . ) may be respectively coupled to the (4N+3)-th output buffers (OB3, . . . , OB4N+3, . . . ), the (4N+3)-th digital-to-analog converters (DAC3, . . . , DAC4N+3, . . . ) may be coupled to the (4N+1)-th output buffers (OB1, . . . , OB4N+1, . . . , the (4N+3)-th data voltages (VD3, . . . , VD4N+3, . . . ) at the (4N+3)-th data channels (CH3, . . . , CH4N+3, . . . ) may be respectively output to the (4N+1)-th data channels (CH1, . . . , CH4N+1, . . . ), the (4N+1)-th data voltages (VD1, . . . , VD4N+1, . . . ) . . . at the (4N+1)-th data channels (CH1, . . . , CH4N+1, . . . ) may be output to the (4N+3)-th data channels (CH3, . . . , CH4N+3, . . . ), and the data swap operation (or the even line data swap operation) may be performed. That is, in a case where the display panel is the RGBG PENTILE™ display panel, the data driver 100 according to embodiments may perform the even line data swap operation with respect to the entire display region (or with respect to the data voltages for the entire display region).

In a case where the pixel arrangement option PAO has a second value (e.g., '1') and the line data LDAT are the odd line data, the switch control block 170 may provide the first switching signals SWS1 to all of the first switches SW1 corresponding to the entire display region of the display panel. Further, in a case where the pixel arrangement option PAO has the second value (e.g., '1') and the line data LDAT are the even line data, the switch control block 170 may provide the second switching signals SWS2 to a portion of the second switches SW2 corresponding to a first display region (e.g., the RGBG PENTILE™ region) of the display panel and may provide the first switching signals SWS1 to a portion of the first switches SW1 corresponding to a second display region (e.g., the RGB stripe region) of the display panel. For example, the pixel arrangement option PAO having the second value (e.g., '1') may represent that the first display region is the RGBG PENTILE™ region and the second display region is the RGB stripe region or that the display panel is a hybrid display panel, and the switch control block 170 may provide the first switching signals SWS1 to all of the first switches SW1 while the odd line data for the hybrid display panel are received, and may provide the second switching signals SWS2 to the portion of the second switches SW2 corresponding to the RGBG PENTILE™ region and the first switching signals SWS1 to the portion of the first switches SW1 corresponding to the RGB stripe region while the even line data for the hybrid display panel are received. Thus, while the odd line data for the hybrid display panel are received, the data swap operation may not be performed. Further, while the even line data for the hybrid display panel are received, odd numbered data voltage corresponding to the first display region (e.g., the RGBG PENTILE™ region) (VD4N+1, VD4N+3, . . . ) at odd numbered data channels (CH4N+1, CH4N+3, . . . ) corresponding to the first display region (e.g., the RGBG PENTILE™ region) may be swapped with each other but data voltages corresponding to the second display region (e.g., the RGB stripe region) may not be swapped. Thus, while the even line data for the hybrid display panel are received, the data swap operation (or the even line data swap operation) may be performed with respect to the RGBG PENTILE™ region and the data swap operation (or the even line data swap operation) may not be performed with respect to the RGB stripe region. That is, in a case where the display panel is the hybrid display panel, the data driver 100 according to embodiments may perform the even line data swap operation with respect to the RGBG PENTILE™ region (or with respect to the data voltages for the RGBG PENTILE™ region), and may not perform the even line data swap operation with respect to the RGB stripe region (or with respect to the data voltages for the RGB stripe region). In another embodiments, while the odd line data for the hybrid display panel are received, the data driver 100 may perform the odd line data swap operation with respect to the RGBG PENTILE™ region (or with respect to the data voltages for the RGBG PENTILE™ region) and may not perform the odd line data swap operation with respect to the RGB stripe region (or with respect to the data voltages for the RGB stripe region).

A conventional data driver may have a configuration and an operation suitable for a corresponding display panel and cannot drive a display panel different from the corresponding display panel. However, the data driver 100 according to embodiments may store the pixel arrangement option PAO representing one of different pixel arrangement structures of various display panels and may be able to drive the various display panels having the different pixel arrangement structures by selectively performing the even line data swap operation according to the pixel arrangement option PAO. In particular, the conventional data driver cannot drive the hybrid display panel including both of the RGBG PENTILE™ region and the RGB stripe region, or may provide data voltages suitable for the RGBG PENTILE™ display panel to the hybrid display panel. Accordingly, in the hybrid display panel driven by the conventional data driver, a color difference and/or a luminance difference may occur between the RGBG PENTILE™ region and the RGB stripe region. However, the data driver 100 according to embodiments may perform the even line data swap operation with respect to the RGBG PENTILE™ region and may not perform the even line data swap operation with respect to the RGB stripe region. Accordingly, the data driver 100 according to embodiments may provide data voltages suitable for the hybrid display panel and may normally drive the hybrid display panel including both of the RGBG PENTILE™ region and the RGB stripe region.

Figure 3:
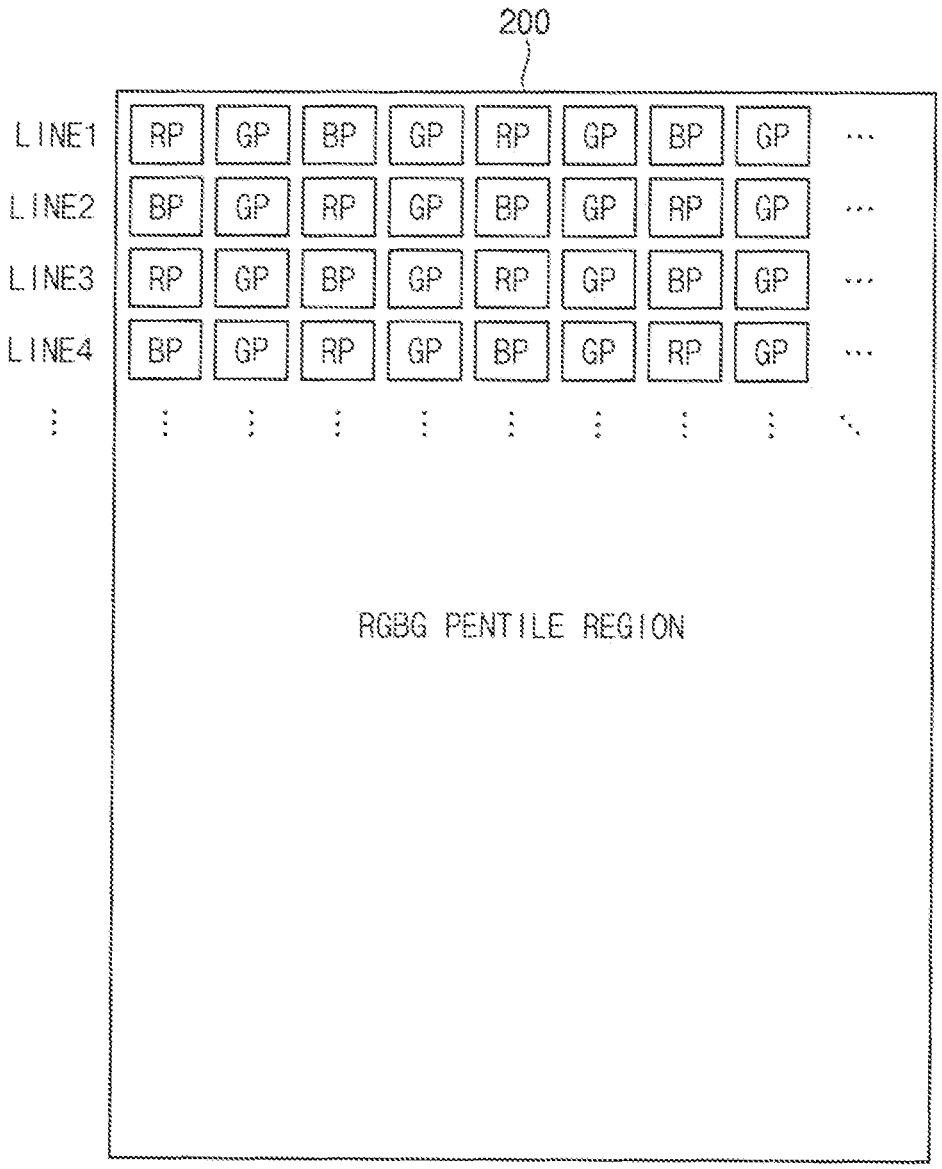
FIG. 3 is a diagram illustrating an example of an RGBG PENTILE™ display panel in which pixels are arranged in an RGBG PENTILE™ pixel arrangement structure in an entire display region.
Figure 4:
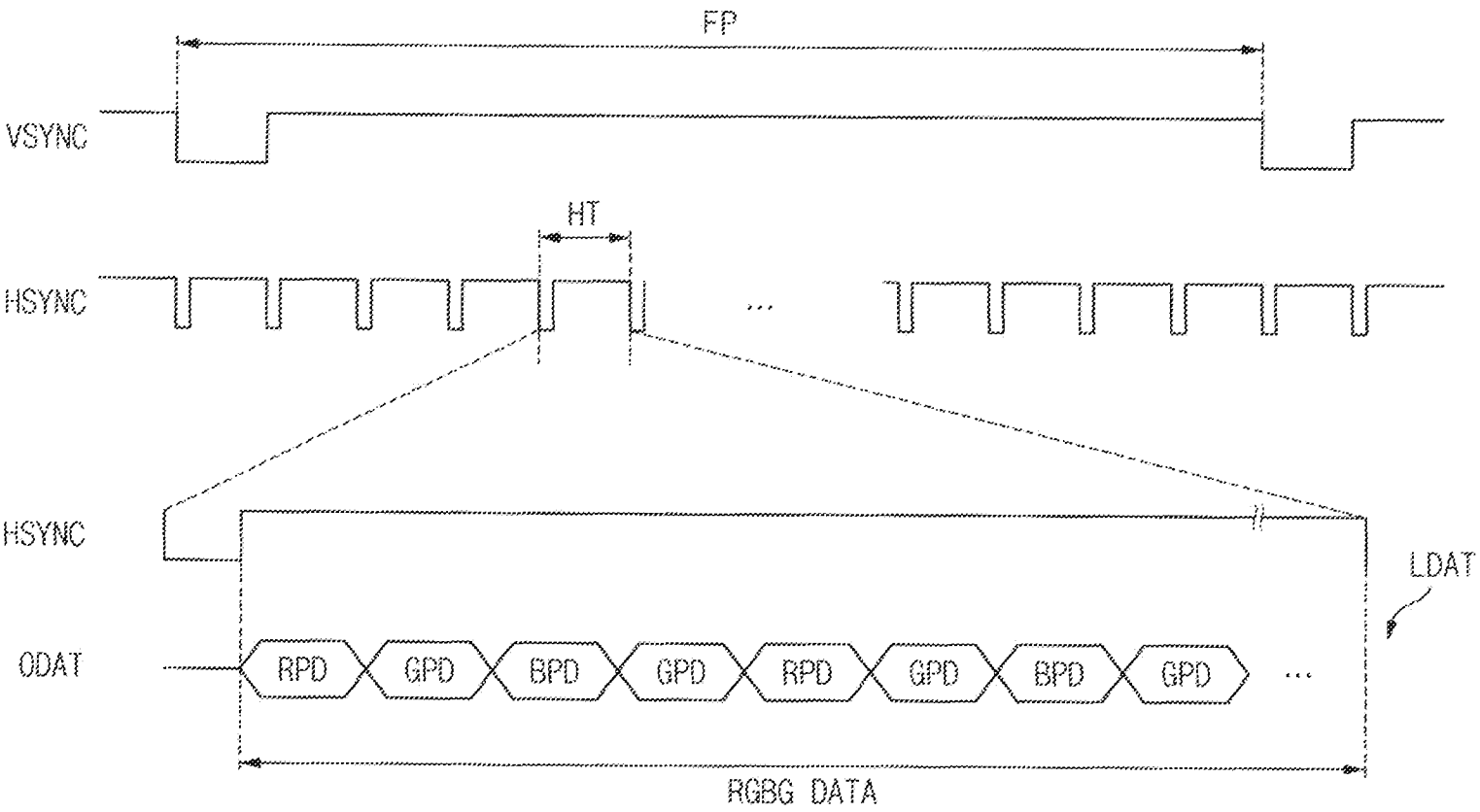
FIG. 4 is a diagram for describing an example of output image data provided to a data driver that drives an RGBG PENTILE™ display panel of FIG. 3.
Figure 6:
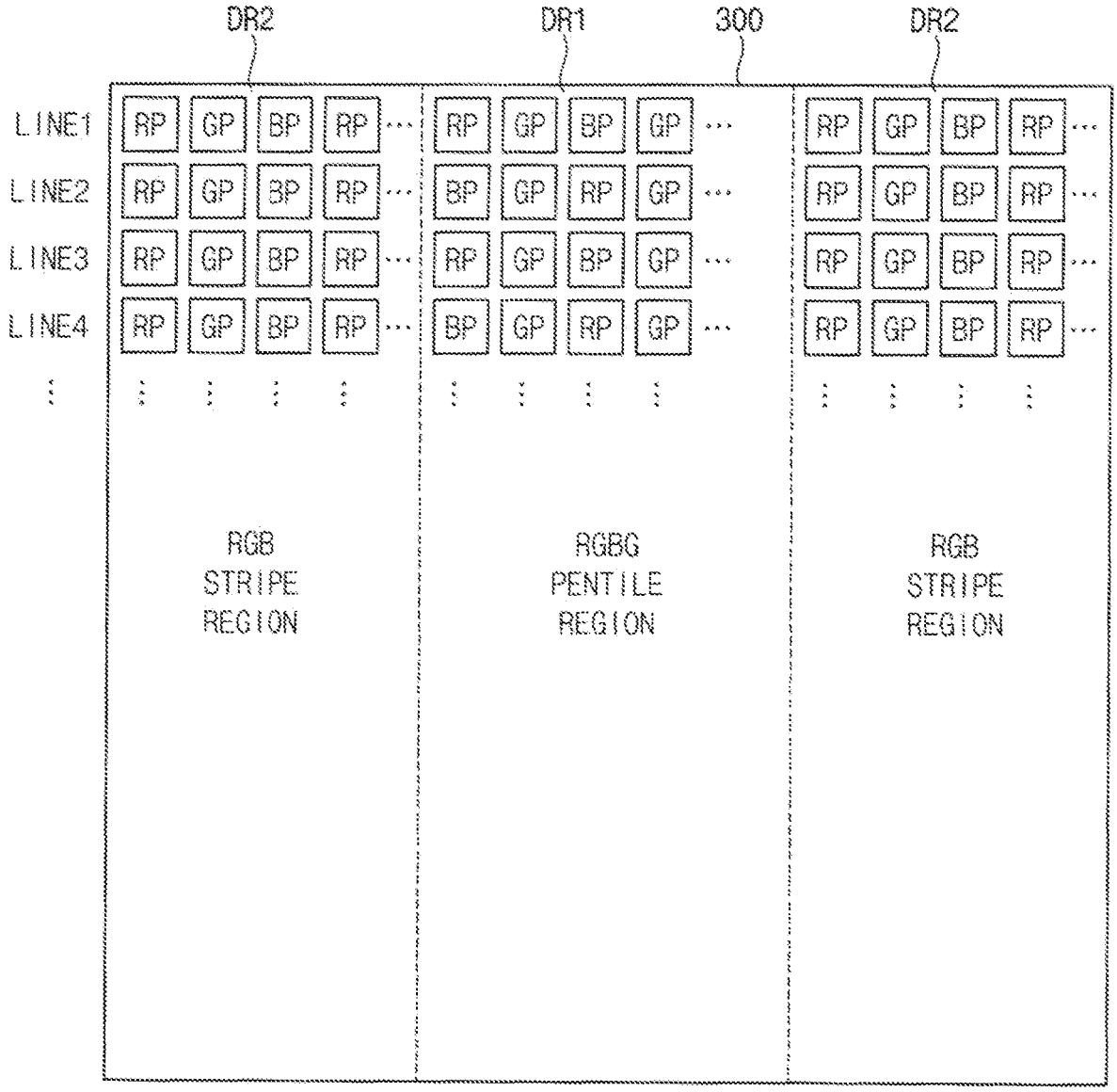
FIG. 6 is a diagram illustrating an example of a hybrid display panel in which pixels are arranged in an RGBG PENTILE™ pixel arrangement structure in a first display region, and pixels are arranged in an RGB stripe pixel arrangement structure in a second display region.
Figure 7:
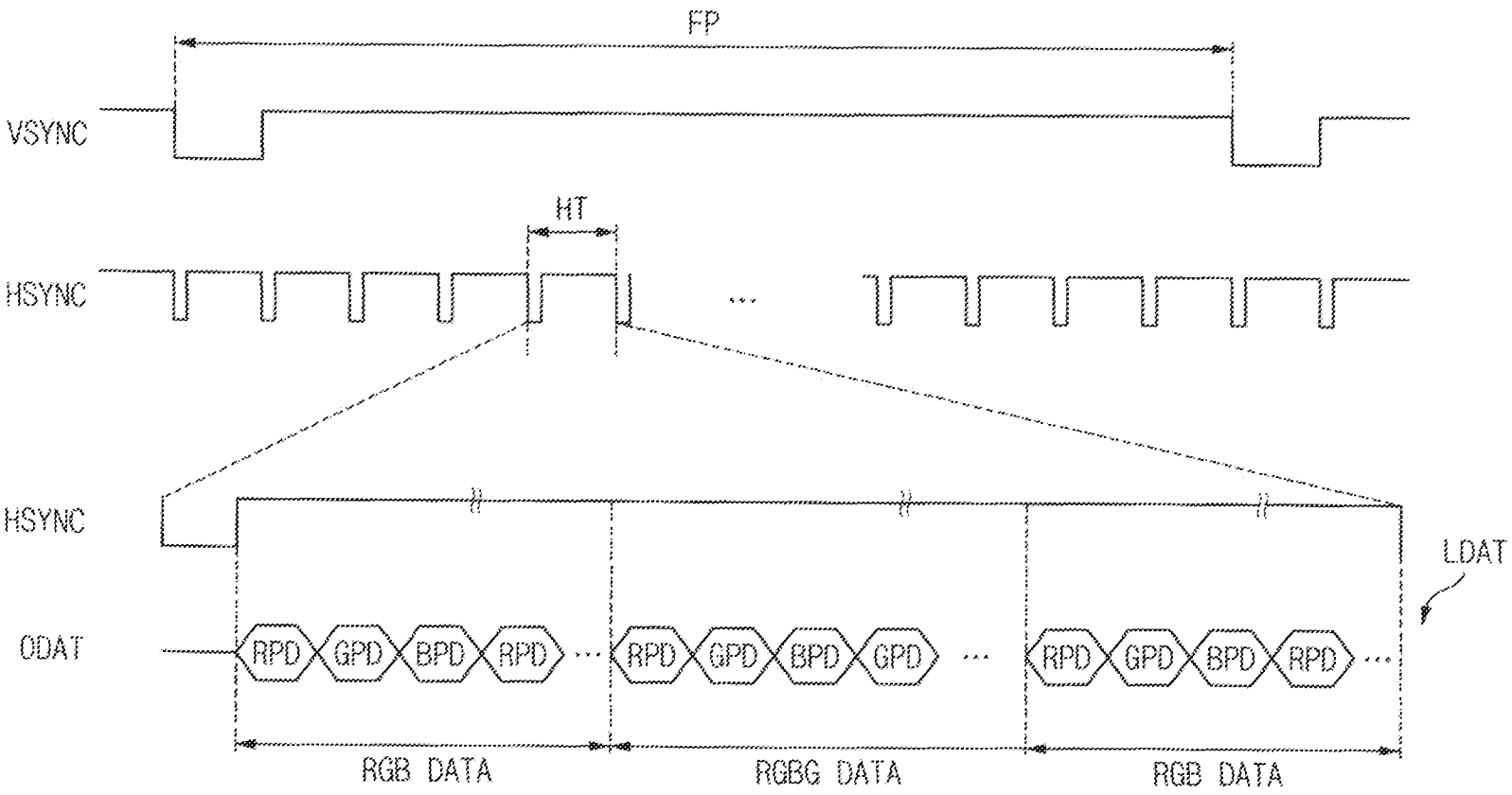
FIG. 7 is a diagram for describing an example of output image data provided to a data driver that drives a hybrid display panel of FIG. 6.

FIG. 2 is a diagram for describing an example of a pixel arrangement option according to embodiments, FIG. 3 is a diagram illustrating an example of an RGBG PENTILE™ display panel in which pixels are arranged in an RGBG PENTILE™ pixel arrangement structure in an entire display region, FIG. 4 is a diagram for describing an example of output image data provided to a data driver that drives an RGBG PENTILE™ display panel of FIG. 3, FIG. 5 is a diagram for describing an example of a data swap operation performed by a data driver that drives an RGBG PENTILE™ display panel of FIG. 3, FIG. 6 is a diagram illustrating an example of a hybrid display panel in which pixels are arranged in an RGBG PENTILE™ pixel arrangement structure in a first display region and pixels are arranged in an RGB stripe pixel arrangement structure in a second display region, FIG. 7 is a diagram for describing an example of output image data provided to a data driver that drives a hybrid display panel of FIG. 6, and FIG. 8 is a diagram for describing an example of a data swap operation performed by a data driver that drives a hybrid display panel of FIG. 6.

Referring to FIGS. 1 and 2, a pixel arrangement option PAO stored in an option storing block 150 of a data driver 100 according to embodiments may represent that an entire display region of a display panel is an RGBG PENTILE™ region or that a first display region of a display panel is the RGBG PENTILE™ region and a second display region of the display panel is an RGB stripe region.

The pixel arrangement option PAO having a first value (e.g., '0') may represent that the entire display region of the display panel is the RGBG PENTILE™ region or that the display panel is an RGBG PENTILE™ display panel 200 as illustrated in FIG. 3. In the RGBG PENTILE™ display panel 200, pixels RP, GP and BP may be arranged in an RGBG PENTILE™ pixel arrangement structure. For example, as illustrated in FIG. 3, a red pixel RP, a green pixel GP, a blue pixel BP and a green pixel GP may be repeatedly arranged in odd pixel lines LINE1, LINE3, . . . (or odd pixel rows) of the RGBG PENTILE™ display panel 200, and a blue pixel BP, a green pixel GP, a red pixel RP and a green pixel GP may be repeatedly arranged in even pixel lines LINE2, LINE4, . . . (or even pixel rows) of the RGBG PENTILE™ display panel 200.

The data driver 100 driving the RGBG PENTILE™ display panel 200 may receive output image data ODAT illustrated in FIG. 4 from a controller of a display device including the data driver 100. As illustrated in FIG. 4, a frame period FP defined by a vertical synchronization signal VSYNC may include a plurality of horizontal times HT defined by a horizontal synchronization signal HSYNC. For example, the number of the plurality of horizontal times HT included in one frame period FP may be substantially the same as pixel lines LINE1, LINE2, LINE3, LINE4, . . . (or pixel rows) of the RGBG PENTILE™ display panel 200. The data driver 100 may receive, as the output image data ODAT, line data LDAT for a corresponding pixel line LINE1, LINE2, LINE3, LINE4, . . . from the controller in each horizontal time HT. The line data LDAT may include pixel data RGD, GPD and BPD for the pixels RP, GP and BP included in the corresponding pixel line LINE1, LINE2, LINE3, LINE4, . . . . As illustrated in FIG. 4, in the line data LDAT for each pixel line LINE1, LINE2, LINE3, LINE4, . . . of the RGBG PENTILE™ display panel 200, red pixel data RPD for a red pixel RP, green pixel data GPD for a green pixel GP, blue pixel data BPD for a blue pixel BP and green pixel data GPD for a green pixel GP may be repeated.

In FIG. 5, to describe an example of a data swap operation (e.g., an even line data swap operation or an even line RB data swap operation) performed by the data driver 100 driving the RGBG PENTILE™ display panel 200, a table 220 for describing an operation of the data driver 100 when odd line data ODD LDAT for each odd pixel line LINE1, LINE3, . . . of the RGBG PENTILE™ display panel 200 are received, and a table 240 for describing an operation of the data driver 100 when even line data EVEN LDAT for each even pixel line LINE2, LINE4, . . . of the RGBG PENTILE™ display panel 200 are received are illustrated.

As illustrated in the table 220 of FIG. 5, when the data driver 100 receives the odd line data ODD LDAT, a plurality of digital-to-analog converters (DAC1, DAC2, DAC3, DAC4, . . . , DAC4N+1, DAC4N+2, DAC4N+3, DAC4N+4, . . . ) at a plurality of data channels (CH1, CH2, CH3, CH4, . . . , CH4N+1, CH4N+2, CH4N+3, CH4N+4, . . . ) may convert a plurality of pixel data (RPD1, GPD2, BPD3, GPD4, . . . , RPD4N+1, GPD4N+2, BPD4N+3, GPD4N+4, . . . ) of the odd line data ODD LDAT into a plurality of data voltages (RVD1, GVD2, BVD3, GVD4, . . . , RVD4N+1, GVD4N+2, BVD4N+3, GVD4N+4, . . . ), respectively. Thus, as illustrated in the table 220 of FIG. 5, data voltages VD @140 output at a digital-to-analog converting block 140 may include a first red data voltage RVD1 corresponding to first red pixel data RPD1 at a first channel CH1, a second green data voltage GVD2 corresponding to second green pixel data GPD2 at a second channel CH2, a third blue data voltage BVD3 corresponding to third blue pixel data BPD3 at a third channel CH3, a fourth green data voltage GVD4 corresponding to fourth green pixel data GPD4 at a fourth channel CH4, a (4N+1)-th red data voltage RVD4N+1 corresponding to (4N+1)-th red pixel data RPD4N+1 at a (4N+1)-th channel CH4N+1, a (4N+2)-th green data voltage GVD4N+2 corresponding to (4N+2)-th green pixel data GPD4N+2 at a (4N+2)-th channel CH4N+2, a (4N+3)-th blue data voltage BVD4N+3 corresponding to (4N+3)-th blue pixel data BPD4N+3 at a (4N+3)-th channel CH4N+3, and a (4N+4)-th green data voltage GVD4N+4 corresponding to (4N+4)-th green pixel data GPD4N+4 at a (4N+4)-th channel CH4N+4. A data swap block 160 may not perform the data swap operation with respect to the entire display region of the RGBG PENTILE™ display panel 200. For example, a switch control block 170 may provide first switching signals SWS1 to all of first switches SW1 corresponding to the entire display region of the RGBG PENTILE™ display panel 200, and a switch block 180 may respectively couple (4N+1)-th and (4N+3)-th digital-to-analog converters (DAC1, DAC3, . . . , DAC4N+1, DAC4N+3, . . . ) to (4N+1)-th and (4N+3)-th output buffers (OB1, OB3, . . . , OB4N+1, OB4N+3, . . . ). Accordingly, the plurality of data voltages (RVD1, GVD2, BVD3, GVD4, . . . , RVD4N+1, GVD4N+2, BVD4N+3, GVD4N+4, . . . ) may be respectively output at a plurality of data channels (CH1, CH2, CH3, CH4, . . . , CH4N+1, CH4N+2, CH4N+3, CH4N+4, . . . ). Thus, as illustrated in the table 220 of FIG. 5, the data voltages VD@140 output at the digital-to-analog converting block 140 and data voltages VD@190 output at an output buffer block 190 may include the same data voltages which are the first red data voltage RVD1 at the first channel CH1, the second green data voltage GVD2 at the second channel CH2, the third blue data voltage BVD3 at the third channel CH3, the fourth green data voltage GVD4 at the fourth channel CH4, the (4N+1)-th red data voltage RVD4N+1 at the (4N+1)-th channel CH4N+1, the (4N+2)-th green data voltage GVD4N+2 at the (4N+2)-th channel CH4N+2, the (4N+3)-th blue data voltage BVD4N+3 at the (4N+3)-th channel CH4N+3, and the (4N+4)-th green data voltage GVD4N+4 at the (4N+4)-th channel CH4N+4.

As illustrated in the table 240 of FIG. 5, when the data driver 100 receives the even line data EVEN LDAT, the plurality of digital-to-analog converters (DAC1, DAC2, DAC3, DAC4, . . . , DAC4N+1, DAC4N+2, DAC4N+3, DAC4N+4, . . . ) at the plurality of data channels (CH1, CH2, CH3, CH4, . . . , CH4N+1, CH4N+2, CH4N+3, CH4N+4, . . . ) may convert a plurality of pixel data (RPD1, GPD2, BPD3, GPD4, . . . , RPD4N+1, GPD4N+2, BPD4N+3, GPD4N+4, . . . ) of the even line data EVEN LDAT into a plurality of data voltages (RVD1, GVD2, BVD3, GVD4, . . . , RVD4N+1, GVD4N+2, BVD4N+3, GVD4N+4, . . . ), respectively. Thus, as illustrated in the table 240 of FIG. 5, data voltages VD@140 output at the digital-to-analog converting block 140 may include a first red data voltage RVD1 corresponding to first red pixel data RPD1 at a first channel CH1, a second green data voltage GVD2 corresponding to second green pixel data GPD2 at a second channel CH2, a third blue data voltage BVD3 corresponding to third blue pixel data BPD3 at a third channel CH3, a fourth green data voltage GVD4 corresponding to fourth green pixel data GPD4 at a fourth channel CH4, a (4N+1)-th red data voltage RVD4N+1 corresponding to (4N+1)-th red pixel data RPD4N+1 at a (4N+1)-th channel CH4N+1, a (4N+2)-th green data voltage GVD4N+2 corresponding to (4N+2)-th green pixel data GPD4N+2 at a (4N+2)-th channel CH4N+2, a (4N+3)-th blue data voltage BVD4N+3 corresponding to (4N+3)-th blue pixel data BPD4N+3 at a (4N+3)-th channel CH4N+3, and a (4N+4)-th green data voltage GVD4N+4 corresponding to (4N+4)-th green pixel data GPD4N+4 at a (4N+4)-th channel CH4N+4. The data swap block 160 may perform the data swap operation with respect to the entire display region of the RGBG PENTILE™ display panel 200. For example, the switch control block 170 may provide second switching signals SWS2 to all of second switches SW2 corresponding to the entire display region of the RGBG PENTILE™ display panel 200, and the switch block 180 may respectively couple the (4N+1)-th digital-to-analog converters (DAC1, . . . , DAC4N+1, . . . ) to the (4N+3)-th output buffers (OB3, . . . , OB4N+3, . . . ), and couple the (4N+3)-th digital-to-analog converters (DAC3, . . . , DAC4N+3, . . . ) to the (4N+1)-th output buffers (OB1, . . . , OB4N+1, . . . ). Accordingly, data voltages BVD3, . . . , BVD4N+3, . . . at (4N+3)-th data channels (CH3, . . . , CH4N+3, . . . ) may be output at (4N+1)-th data channels (CH1, . . . , CH4N+1, . . . ), and data voltages RVD1, . . . , RVD4N+1, . . . at the (4N+1)-th data channels (CH1, . . . , CH4N+1, . . . ) may be output at the (4N+3)-th data channels (CH3, . . . , CH4N+3, . . . ), respectively. Thus, as illustrated in the table 240 of FIG. 5, unlike the data voltages VD@140 output at the digital-to-analog converting block 140, data voltages VD@190 output at the output buffer block 190 may include the third blue data voltage BVD3 at the first channel CH1, the second green data voltage GVD2 at the second channel CH2, the first red data voltage RVD1 at the third channel CH3, the fourth green data voltage GVD4 at the fourth channel CH4, the (4N+3)-th blue data voltage BVD4N+3 at the (4N+1)-th channel CH4N+1, the (4N+2)-th green data voltage GVD4N+2 at the (4N+2)-th channel CH4N+2, the (4N+1)-th red data voltage RVD4N+1 at the (4N+3)-th channel CH4N+3, and the (4N+4)-th green data voltage GVD4N+4 at the (4N+4)-th channel CH4N+4.

Thus, the data driver 100 driving the RGBG PENTILE™ display panel 200 may store the pixel arrangement option PAO having the first value (e.g., '0') and may perform the even line data swap operation that swaps the data voltages BVD3, . . . , BVD4N+3, . . . at the (4N+3)-th data channels (CH3, . . . , CH4N+3, . . . ) and the data voltages RVD1, . . . , RVD4N+1, . . . at the (4N+1)-th data channels (CH1, . . . , CH4N+1, . . . ) with each other among the data voltages (RVD1, GVD2, BVD3, GVD4, . . . , RVD4N+1, GVD4N+2, BVD4N+3, GVD4N+4, . . . ) corresponding to the even line data EVEN LDAT with respect to the entire display region of the RGBG PENTILE™ display panel 200.

The pixel arrangement option PAO having a second value (e.g., '1') may represent that the first display region of the display panel is the RGBG PENTILE™ region and the second display region of the display panel is the RGB stripe region, and that the display panel is a hybrid display panel 300 as illustrated in FIG. 6. As illustrated in FIG. 6, the first display region DR1 of the hybrid display panel 300 may be the RGBG PENTILE™ region in which pixels RP, GP and BP are arranged in the RGBG PENTILE™ pixel arrangement structure, and the second display region DR2 of the hybrid display panel 300 may be the RGB stripe region in which pixels RP, GP and BP are arranged in an RGB stripe pixel arrangement structure. For example, as illustrated in FIG. 6, in the first display region DR1 of the hybrid display panel 300, a red pixel RP, a green pixel GP, a blue pixel BP and a green pixel GP may be repeatedly arranged in odd pixel lines LINE1, LINE3, . . . (or odd pixel rows), and a blue pixel BP, a green pixel GP, a red pixel RP and a green pixel GP may be repeatedly arranged in even pixel lines LINE2, LINE4, . . . . Further, in the second display region DR2 of the hybrid display panel 300, a red pixel RP, a green pixel GP and a blue pixel BP may be repeatedly arranged in each pixel line LINE1, LINE2, LINE3, LINE4, . . . .

In some embodiments, the first display region DR1 of the hybrid display panel 300 may be a center region disposed at a center of the hybrid display panel 300 and the second display region DR2 of the hybrid display panel 300 may be a pixel on driver (POD) region disposed at both sides of the hybrid display panel 300. Here, the POD region may be a region where a driver (e.g., a scan driver) is formed along with the pixels RP, GP and BP.

The data driver 100 driving the hybrid display panel 300 may receive output image data ODAT illustrated in FIG. 7 from a controller of a display device including the data driver 100. As illustrated in FIG. 7, the data driver 100 may receive, as the output image data ODAT, line data LDAT for a corresponding pixel line LINE1, LINE2, LINE3, LINE4, . . . from the controller in each horizontal time HT. The line data LDAT may sequentially include RGB data for the RGB stripe region disposed on one side of the RGBG PENTILE™ region, RGBG data for the RGBG PENTILE™ region, and RGB data for the RGB stripe region disposed on the other side of the RGBG PENTILE™ region opposing the one side. Further, the RGB data for the RGB stripe region may repeatedly include red pixel data RPD, green pixel data GPD and blue pixel data BPD, and the RGBG data for the RGBG PENTILE™ region may repeatedly include red pixel data RPD, green pixel data GPD, blue pixel data BPD and green pixel data GPD.

In FIG. 8, to describe an example of a data swap operation performed by the data driver 100 driving the hybrid display panel 300, a table 320 for describing an operation of the data driver 100 when odd line data ODD LDAT for each odd pixel line LINE1, LINE3, . . . of the hybrid display panel 300 are received, and a table 340 for describing an operation of the data driver 100 when even line data EVEN LDAT for each even pixel line LINE2, LINE4, . . . of the hybrid display panel 300 are received are illustrated.

As illustrated in the table 320 of FIG. 8, when the data driver 100 receives the odd line data ODD LDAT, the digital-to-analog converting block 140 may convert a plurality of pixel data (RPD1, GPD2, BPD3, RPD4, . . . , RPDK+1, GPDK+2, BPDK+3, GPDK+4, . . . , RPDL+1, GPDL+2, BPDL+3, RPDL+4, . . . ) of the odd line data ODD LDAT into a plurality of data voltages (RVD1, GVD2, BVD3, RVD4, . . . , RVDK+1, GVDK+2, BVDK+3, GVDK+4, . . . , RVDL+1, GVDL+2, BVDL+3, RVDL+4, . . . ) at a plurality of data channels (CH1, CH2, CH3, CH4, . . . , CHK+1, CHK+2, CHK+3, CHK+4, . . . , CHL+1, CHL+2, CHL+3, CHL+4, . . . ), respectively. Thus, as illustrated in the table 320 of FIG. 8, data voltages VD@140 output at the digital-to-analog converting block 140 may include a first red data voltage RVD1 corresponding to first red pixel data RPD1 at a first channel CH1 for the second display region DR2, a second green data voltage GVD2 corresponding to second green pixel data GPD2 at a second channel CH2 for the second display region DR2, a third blue data voltage BVD3 corresponding to third blue pixel data BPD3 at a third channel CH3 for the second display region DR2, a fourth red data voltage RVD4 corresponding to fourth red pixel data RPD4 at a fourth channel CH4 for the second display region DR2, a (K+1)-th red data voltage RVDK+1 corresponding to (K+1)-th red pixel data RPDK+1 at a (K+1)-th channel CHK+1 for the first display region DR1, a (K+2)-th green data voltage GVDK+2 corresponding to (K+2)-th green pixel data GPDK+2 at a (K+2)-th channel CHK+2 for the first display region DR1, a (K+3)-th blue data voltage BVDK+3 corresponding to (K+3)-th blue pixel data BPDK+3 at a (K+3)-th channel CHK+3 for the first display region DR1, a (K+4)-th green data voltage GVDK+4 corresponding to (K+4)-th green pixel data GPDK+4 at a (K+4)-th channel CHK+4 for the first display region DR1, a (L+1)-th red data voltage RVDL+1 corresponding to (L+1)-th red pixel data RPDL+1 at a (L+1)-th channel CHL+1 for the second display region DR2, a (L+2)-th green data voltage GVDL+2 corresponding to (L+2)-th green pixel data GPDL+2 at a (L+2)-th channel CHL+2 for the second display region DR2, a (L+3)-th blue data voltage BVDL+3 corresponding to (L+3)-th blue pixel data BPDL+3 at a (L+3)-th channel CHL+3 for the second display region DR2, and a (L+4)-th red data voltage RVDL+4 corresponding to (L+4)-th red pixel data RPDL+4 at a (L+4)-th channel CHL+4 for the second display region DR2. The data swap block 160 may not perform the data swap operation with respect to the entire display region, or the first and second display regions DR1 and DR2 of the hybrid display panel 300. For example, the switch control block 170 may provide the first switching signals SWS1 to all of the first switches SW1 corresponding to the entire display region of the hybrid display panel 300, and the switch block 180 may respectively couple the (4N+1)-th and (4N+3)-th digital-to-analog converters (DAC1, DAC3, . . . , DAC4N+1, DAC4N+3, . . . ) to the (4N+1)-th and (4N+3)-th output buffers (OB1, OB3, . . . , OB4N+1, OB4N+3, . . . ). Accordingly, the plurality of data voltages (RVD1, GVD2, BVD3, RVD4, . . . , RVDK+1, GVDK+2, BVDK+3, GVDK+4, . . . , RVDL+1, GVDL+2, BVDL+3, RVDL+4, . . . ) may be respectively output at the plurality of data channels (CH1, CH2, CH3, CH4, . . . , CHK+1, CHK+2, CHK+3, CHK+4, . . . , CHL+1, CHL+2, CHL+3, CHL+4, . . . ). Thus, as illustrated in the table 320 of FIG. 8, the data voltages VD@140 output at the digital-to-analog converting block 140 and data voltages VD @190 output at the output buffer block 190 may include the same data voltages which are the first red data voltage RVD1 at the first channel CH1 for the second display region DR2, the second green data voltage GVD2 at the second channel CH2 for the second display region DR2, the third blue data voltage BVD3 at the third channel CH3 for the second display region DR2, the fourth red data voltage RVD4 at the fourth channel CH4 for the second display region DR2, the (K+1)-th red data voltage RVDK+1 at the (K+1)-th channel CHK+1 for the first display region DR1, the (K+2)-th green data voltage GVDK+2 at the (K+2)-th channel CHK+2 for the first display region DR1, the (K+3)-th blue data voltage BVDK+3 at the (K+3)-th channel CHK+3 for the first display region DR1, the (K+4)-th green data voltage GVDK+4 at the (K+4)-th channel CHK+4 for the first display region DR1, the (L+1)-th red data voltage RVDL+1 at the (L+1)-th channel CHL+1 for the second display region DR2, the (L+2)-th green data voltage GVDL+2 at the (L+2)-th channel CHL+2 for the second display region DR2, the (L+3)-th blue data voltage BVDL+3 at the (L+3)-th channel CHL+3 for the second display region DR2, and the (L+4)-th red data voltage RVDL+4 at the (L+4)-th channel CHL+4 for the second display region DR2.

As illustrated in the table 340 of FIG. 8, when the data driver 100 receives the even line data EVEN LDAT, the digital-to-analog converting block 140 may convert a plurality of pixel data (RPD1, GPD2, BPD3, RPD4, . . . , RPDK+1, GPDK+2, BPDK+3, GPDK+4, . . . , RPDL+1, GPDL+2, BPDL+3, RPDL+4, . . . ) of the even line data EVEN LDAT into a plurality of data voltages (RVD1, GVD2, BVD3, RVD4, . . . , RVDK+1, GVDK+2, BVDK+3, GVDK+4, . . . , RVDL+1, GVDL+2, BVDL+3, RVDL+4, . . . ) at the plurality of data channels (CH1, CH2, CH3, CH4, . . . , CHK+1, CHK+2, CHK+3, CHK+4, . . . , CHL+1, CHL+2, CHL+3, CHL+4, . . . ), respectively. Thus, as illustrated in the table 340 of FIG. 8, data voltages VD @140 output at the digital-to-analog converting block 140 may include a first red data voltage RVD1 corresponding to first red pixel data RPD1 at the first channel CH1 for the second display region DR2, a second green data voltage GVD2 corresponding to second green pixel data GPD2 at the second channel CH2 for the second display region DR2, a third blue data voltage BVD3 corresponding to third blue pixel data BPD3 at the third channel CH3 for the second display region DR2, a fourth red data voltage RVD4 corresponding to fourth red pixel data RPD4 at the fourth channel CH4 for the second display region DR2, a (K+1)-th red data voltage RVDK+1 corresponding to (K+1)-th red pixel data RPDK+1 at the (K+1)-th channel CHK+1 for the first display region DR1, a (K+2)-th green data voltage GVDK+2 corresponding to (K+2)-th green pixel data GPDK+2 at the (K+2)-th channel CHK+2 for the first display region DR1, a (K+3)-th blue data voltage BVDK+3 corresponding to (K+3)-th blue pixel data BPDK+3 at the (K+3)-th channel CHK+3 for the first display region DR1, a (K+4)-th green data voltage GVDK+4 corresponding to (K+4)-th green pixel data GPDK+4 at the (K+4)-th channel CHK+4 for the first display region DR1, a (L+1)-th red data voltage RVDL+1 corresponding to (L+1)-th red pixel data RPDL+1 at the (L+1)-th channel CHL+1 for the second display region DR2, a (L+2)-th green data voltage GVDL+2 corresponding to (L+2)-th green pixel data GPDL+2 at the (L+2)-th channel CHL+2 for the second display region DR2, a (L+3)-th blue data voltage BVDL+3 corresponding to (L+3)-th blue pixel data BPDL+3 at the (L+3)-th channel CHL+3 for the second display region DR2, and a (L+4)-th red data voltage RVDL+4 corresponding to (L+4)-th red pixel data RPDL+4 at the (L+4)-th channel CHL+4 for the second display region DR2. The data swap block 160 may perform the data swap operation with respect to the first display region DR1 of the hybrid display panel 300 and may not perform the data swap operation with respect to the second display region DR2 of the hybrid display panel 300. For example, the switch control block 170 may provide the second switching signals SWS2 to a portion of the second switches SW2 corresponding to the first display region DR1 of the hybrid display panel 300 and may provide the first switching signals SWS1 to a portion of the first switches SW1 corresponding to the second display region DR2 of the hybrid display panel 300. Thus, at the data channels (CHK+1, CHK+2, CHK+3, CHK+4, . . . ) coupled to the first display region DR1, the switch block 180 may couple the (4N+1)-th digital-to-analog converter DAC4N+1 to the (4N+3)-th output buffer OB4N+3, and may couple the (4N+3)-th digital-to-analog converter DAC4N+3 to the (4N+1)-th output buffer OB4N+1. Further, at the data channels (CH1, CH2, CH3, CH4, . . . , CHL+1, CHL+2, CHL+3, CHL+4, . . . ) coupled to the second display region DR2, the switch block 180 may respectively couple the (4N+1)-th and (4N+3)-th digital-to-analog converter DAC4N+1 and DAC4N+3 to the (4N+1)-th and (4N+3)-th output buffers OB4N+1 and OB4N+3. Accordingly, data voltages (BVDK+3, GVDK+2, RVDK+1, GVDK+4, . . . ) on which the data swap operation is performed may be respectively output at the data channels (CHK+1, CHK+2, CHK+3, CHK+4, . . . ) coupled to the first display region DR1, and data voltages (RVD1, GVD2, BVD3, RVD4, . . . , RVDL+1, GVDL+2, BVDL+3, RVDL+4, . . . ) on which the data swap operation is not performed may be respectively output at the data channels (CH1, CH2, CH3, CH4, . . . , CHL+1, CHL+2, CHL+3, CHL+4, . . . ) coupled to the second display region DR2. Thus, as illustrated in the table 340 of FIG. 8, the data voltages VD@140 output at the digital-to-analog converting block 140 with respect to the second display region DR2 and data voltages VD@190 output at the output buffer block 190 with respect to the second display region DR2 may include the same data voltages which are the first red data voltage RVD1 at the first channel CH1, the second green data voltage GVD2 at the second channel CH2, the third blue data voltage BVD3 at the third channel CH3, the fourth red data voltage RVD4 at the fourth channel CH4, the (L+1)-th red data voltage RVDL+1 at the (L+1)-th channel CHL+1, the (L+2)-th green data voltage GVDL+2 at the (L+2)-th channel CHL+2, the (L+3)-th blue data voltage BVDL+3 at the (L+3)-th channel CHL+3, and the (L+4)-th red data voltage RVDL+4 at the (L+4)-th channel CHL+4. However, as illustrated in the table 340 of FIG. 8, unlike the data voltages VD@140 output at the digital-to-analog converting block 140 with respect to the first display region DR1, data voltages VD@190 output at the output buffer block 190 with respect to the first display region DR1 may include the (K+3)-th blue data voltage BVDK+3 at the (K+1)-th channel CHK+1, the (K+2)-th green data voltage GVDK+2 at the (K+2)-th channel CHK+2, the (K+1)-th red data voltage RVDK+1 at the (K+3)-th channel CHK+3, and the (K+4)-th green data voltage GVDK+4 at the (K+4)-th channel CHK+4.

Thus, the data driver 100 driving the hybrid display panel 300 may store the pixel arrangement option PAO having the second value (e.g., '1'), may perform the even line data swap operation that swaps the data voltage (e.g., RVDK+1) at the (4N+1)-th data channel (e.g., CHK+1) and the data voltage (e.g., BVDK+3) at the (4N+3)-th data channel (e.g., CHK+3) with each other among the data voltages (RVDK+1, GVDK+2, BVDK+3, GVDK+4, . . . ) corresponding to the even line data EVEN LDAT with respect to the first display region DR1 of the hybrid display panel 300, and may not perform the even line data swap operation with respect to the second display region DR2 of the hybrid display panel 300.

As described above, the data driver 100 according to embodiments may store the pixel arrangement option PAO representing the RGBG PENTILE™ display panel 200 or the hybrid display panel 300 and may perform an operation suitable for the RGBG PENTILE™ display panel 200 or the hybrid display panel 300 according to the pixel arrangement option PAO. Thus, the data driver 100 may drive various display panels including the RGBG PENTILE™ display panel 200 and the hybrid display panel 300.

Figure 10:
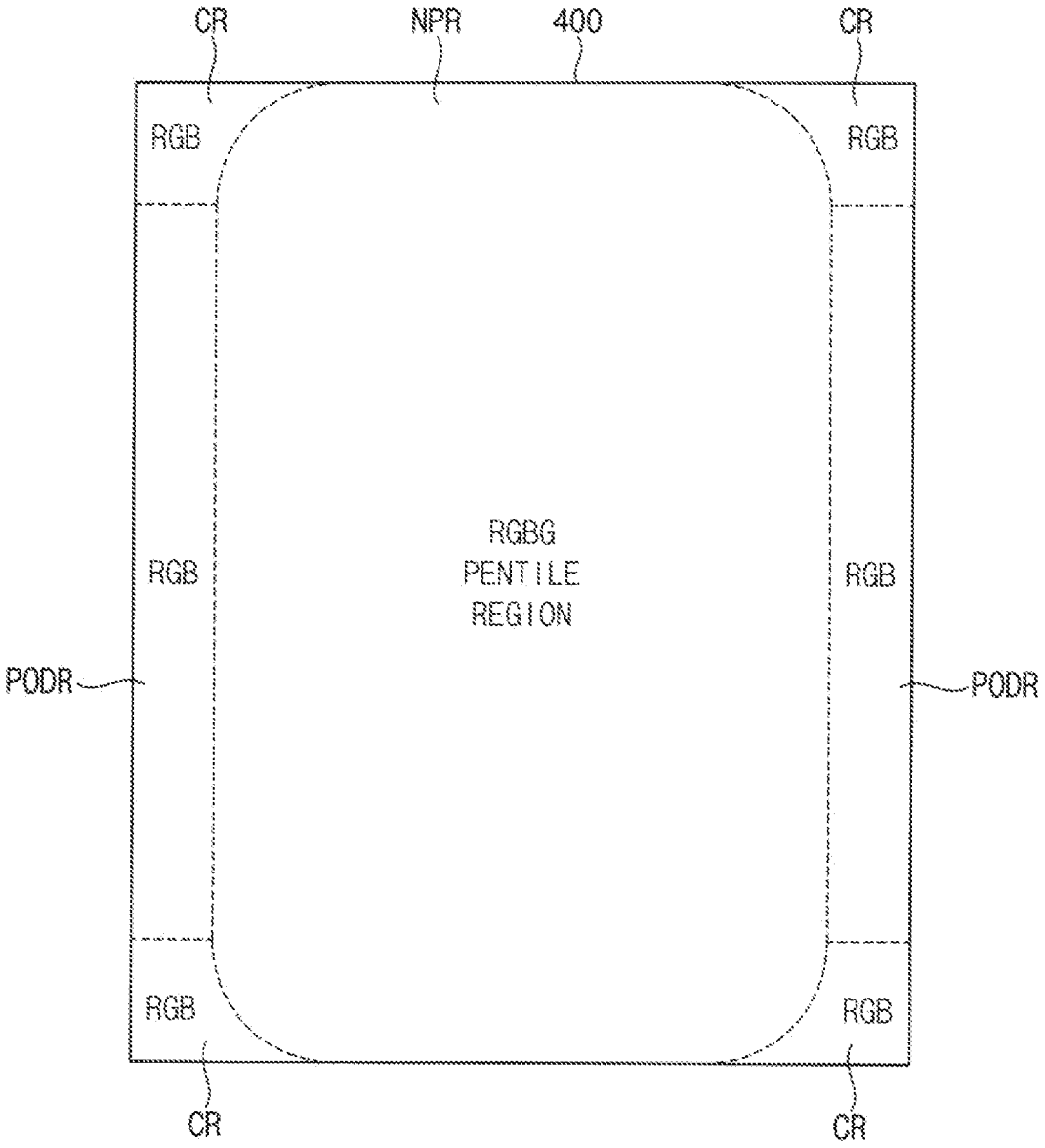
FIG. 10 is a diagram illustrating an example of a hybrid display panel in which pixels are arranged in an RGBG PENTILE™ pixel arrangement structure in a center region, and pixels are arranged in an RGB stripe pixel arrangement structure in a pixel on driver (POD) region and a corner region.
Figure 11:
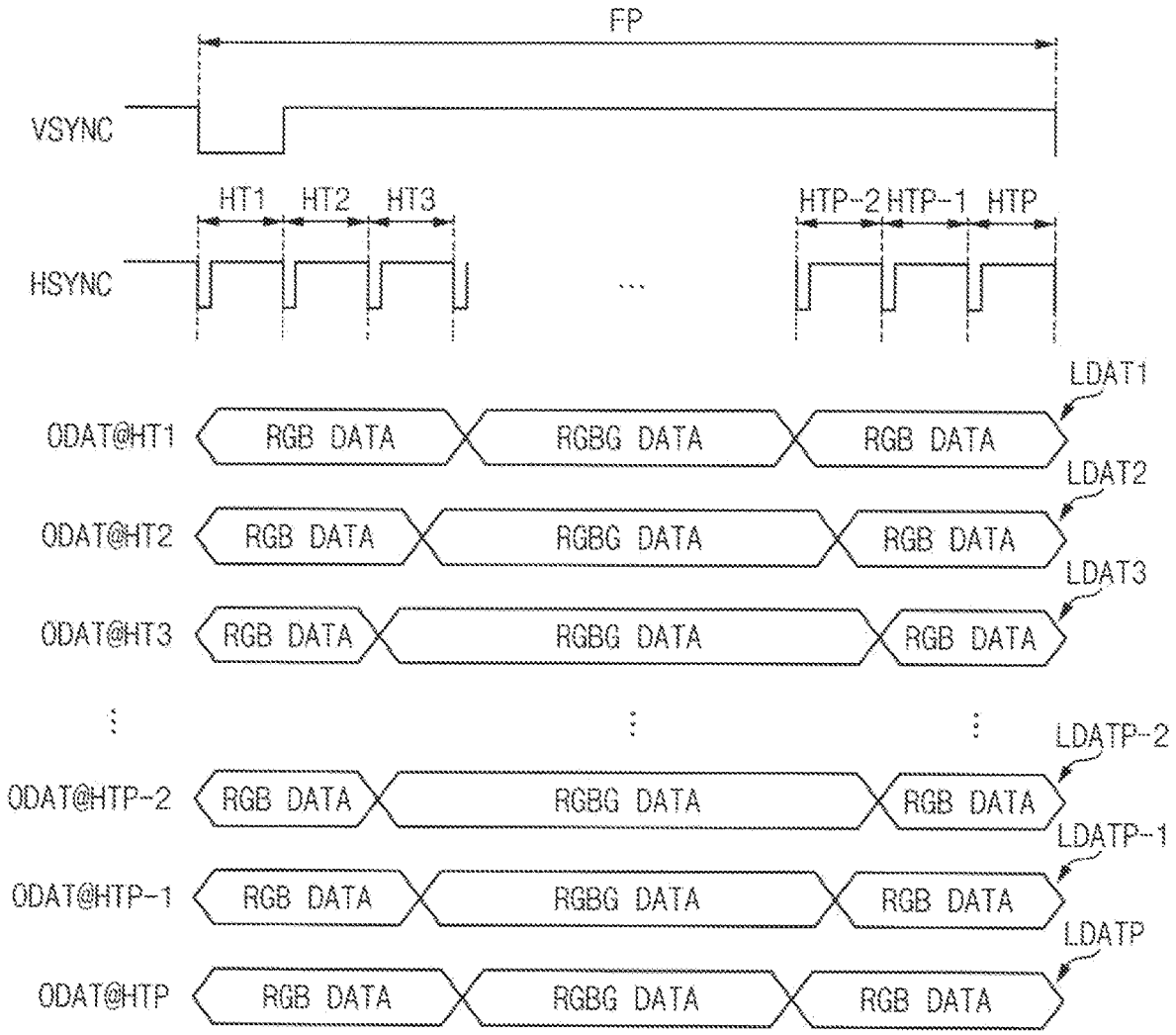
FIG. 11 is a diagram for describing an example of output image data provided to a data driver that drives a hybrid display panel of FIG. 10.

FIG. 9 is a diagram for describing another example of a pixel arrangement option according to embodiments, FIG. 10 is a diagram illustrating an example of a hybrid display panel in which pixels are arranged in an RGBG PENTILE™ pixel arrangement structure in a center region, and pixels are arranged in an RGB stripe pixel arrangement structure in a pixel on driver (POD) region (PODR) and a corner region (CR), and FIG. 11 is a diagram for describing an example of output image data provided to a data driver that drives a hybrid display panel of FIG. 10.

Referring to FIGS. 1 and 9, a pixel arrangement option PAO stored in an option storing block 150 of a data driver 100 according to embodiments may represent that an entire display region of a display panel is an RGBG PENTILE™ region, or that a first display region (e.g., a center region) of a display panel is the RGBG PENTILE™ region, and a second display region (e.g., a POD region and a corner region) of the display panel is an RGB stripe region.

The pixel arrangement option PAO having a first value (e.g., '0') may represent that the entire display region of the display panel is the RGBG PENTILE™ region or that the display panel is an RGBG PENTILE™ display panel 200 as illustrated in FIG. 3. As described above with reference to FIGS. 3 through 5, the data driver 100 driving the RGBG PENTILE™ display panel 200 may store the pixel arrangement option PAO having the first value (e.g., '0'), and may perform the even line data swap operation with respect to the entire display region of the RGBG PENTILE™ display panel 200.

The pixel arrangement option PAO having a second value (e.g., '1') may represent that the first display region (e.g., the center region) of the display panel is the RGBG PENTILE™ region and the second display region (e.g., the POD region and the corner region) of the display panel is the RGB stripe region, and that the display panel is a hybrid display panel 400 as illustrated in FIG. 10. For example, the hybrid display panel 400 of FIG. 10 may be referred to as a corner display panel. As illustrated in FIG. 10, the center region NPR disposed at a center of the hybrid display panel 400 may be the RGBG PENTILE™ region in which pixels are arranged in an RGBG PENTILE™ pixel arrangement structure, and the POD region PODR disposed at both sides of the hybrid display panel 400 and the corner region CR disposed at four corners of the hybrid display panel 400 may be the RGB stripe region in which pixels are arranged in an RGB stripe pixel arrangement structure.

The data driver 100 driving the hybrid display panel 400 may receive output image data ODAT illustrated in FIG. 11 from a controller of a display device including the data driver 100. As illustrated in FIG. 11, the data driver 100 may receive, as the output image data (ODAT@HT1, ODAT@HT2, ODAT@HT3, . . . ODAT@HTP-2, ODAT@HTP-1 and ODAT@HTP), line data (LDAT1, LDAT2, LDAT3, . . . LDATP-2, LDATP-1 and LDATP) for a corresponding pixel line from the controller in each horizontal time (HT1, HT2, HT3, . . . HTP-2, HTP-1 and HTP). Each line data (LDAT1, LDAT2, LDAT3, . . . LDATP-2, LDATP-1 and LDATP) may sequentially include RGB data, RGBG data and RGB data. As illustrated in FIGS. 10 and 11, in line data LDAT1, LDAT2 and LDAT3 for an upper region of the hybrid display panel 400 in which widths of the corner regions CR gradually decrease, sizes of the RGB data may gradually decrease, and a size of the RGBG data may increase. Further, in line data LDATP-2, LDATP-1 and LDATP for a lower region of the hybrid display panel 400 in which the widths of the corner regions CR gradually increase, the sizes of the RGB data may gradually increase, and the size of the RGBG data may decrease.

Thus, the data driver 100 driving the hybrid display panel 400 (e.g., the corner display panel) may store the pixel arrangement option PAO having the second value (e.g., '1'), may perform the even line data swap operation with respect to the center region NPR of the hybrid display panel 400 and may not perform the even line data swap operation with respect to the POD region PODR and the corner region CR of the hybrid display panel 400. Thus, the data driver 100 may drive various display panels including the RGBG PENTILE™ display panel 200 and the hybrid display panel 400 (e.g., the corner display panel).

FIG. 12 is a diagram for describing still another example of a pixel arrangement option according to embodiments.

Referring to FIGS. 1 and 12, a pixel arrangement option PAO stored in an option storing block 150 of a data driver 100 according to embodiments may have two or more bits to represent one of three or more pixel arrangement structures.

For example, as illustrated in FIG. 12, the pixel arrangement option PAO having a first value (e.g., '0') may represent that an entire display region of a display panel is an RGBG PENTILE™ region. Further, the pixel arrangement option PAO having a second value (e.g., '1') may represent that a first center region disposed at a center of a display panel is the RGBG PENTILE™ region, and a first POD region disposed at both sides of the display panel and corresponding to a first number of data channels is an RGB stripe region. Further, the pixel arrangement option PAO having a third value (e.g., '2') may represent that a second center region disposed at the center of a display panel is the RGBG PENTILE™ region, and a second POD region disposed at both sides of the display panel and corresponding to a second number (different from the first number) of data channels is the RGB stripe region. For example, the second number may be greater than the first number, a width of the second POD region may be wider than a width of the first POD region, and a width of the second center region may be narrower than a width of the first center region. Further, the pixel arrangement option PAO having a fourth value (e.g., '3') may represent that a third center region disposed at the center of a display panel is the RGBG PENTILE™ region, and a third POD region PODR disposed at both sides of the display panel and a corner region CR disposed at four corners of the display panel is the RGB stripe region. Although FIG. 12 illustrates an example of the pixel arrangement option PAO having two bits, pixel arrangement structures corresponding to values of the pixel arrangement option PAO and the number of bits of the pixel arrangement option PAO are not limited to the example of FIG. 12.

As described above, the data driver 100 according to embodiments may store the pixel arrangement option PAO having two or more bits, and may drive various display panels having different pixel arrangement structures according to the pixel arrangement option PAO.

Figure 13:
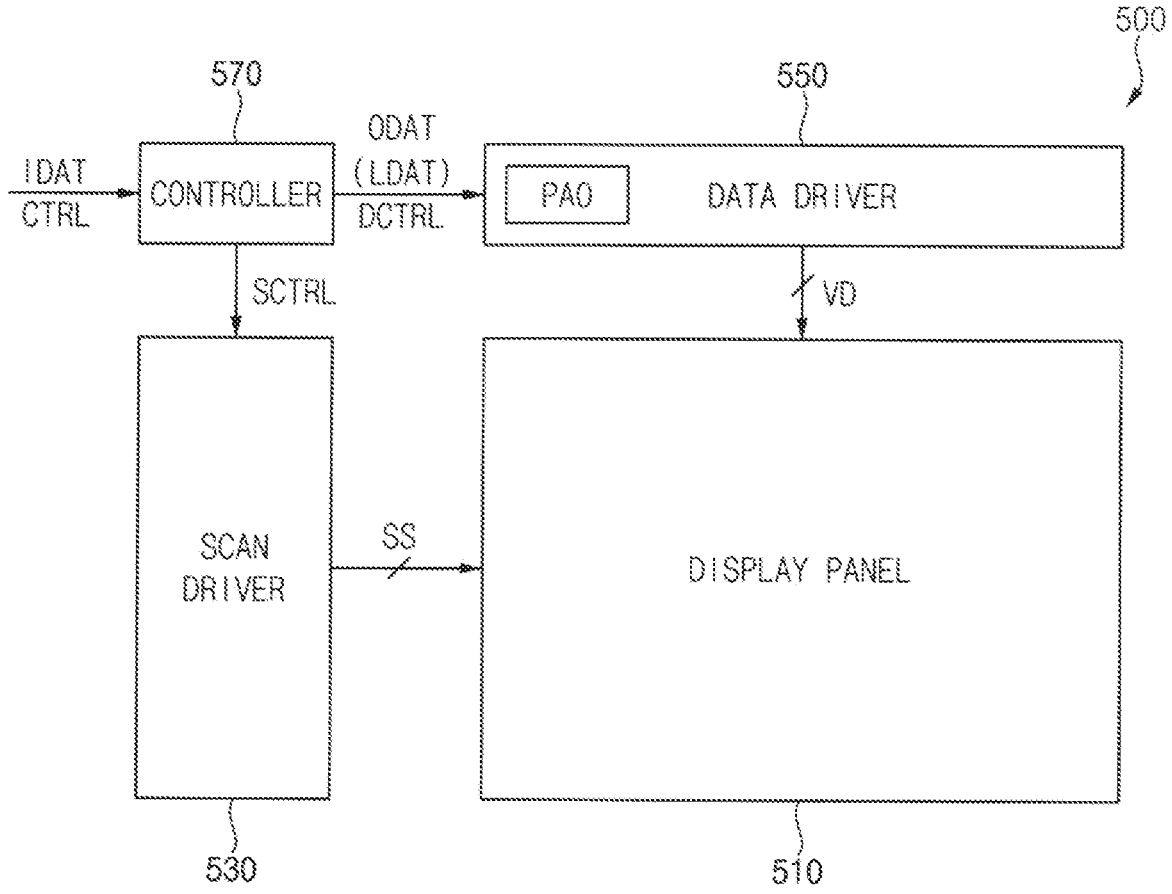
FIG. 13 is a block diagram illustrating a display device including a data driver according to embodiments.

FIG. 13 is a block diagram illustrating a display device including a data driver according to embodiments.

Referring to FIG. 13, a display device 500 according to embodiments may include a display panel 510, a scan driver 530 that provides scan signals SS to the display panel 510, a data driver 550 that provides data voltages DV to the display panel 510, and a controller 570 that controls the scan driver 530 and the data driver 550.

The display panel 510 may include a plurality of scan lines, a plurality of data lines, and a plurality of pixels coupled to the plurality of scan lines and the plurality of data lines. In some embodiments, each pixel may include at least two transistors, at least one capacitor and a light emitting diode, and the display panel 510 may be a light emitting display panel. For example, the display panel 510 may be an organic light emitting diode (OLED) display panel. In other embodiments, each pixel may include a switching transistor, and a liquid crystal capacitor coupled to the switching transistor, and the display panel 510 may be a liquid crystal display (LCD) panel. However, the display panel 510 may not be limited to the light emitting display panel and the LCD panel, and may be any suitable display panel.

The scan driver 530 may generate the scan signals SS based on a scan control signal SCTRL received from the controller 570, and may sequentially provide the scan signals SS to the plurality of pixels on a row-by-row basis through the plurality of scan lines. In some embodiments, the scan control signal SCTRL may include, but not limited to, a scan start signal, a scan clock signal, etc. In some embodiments, the scan driver 530 may be integrated or formed in a peripheral portion of the display panel 510. In other embodiments, the scan driver 530 may be integrated or formed in at least a portion (e.g., a POD region) of a display region of the display panel 510. In still other embodiments, the scan driver 530 may be implemented in a form of an integrated circuit.

The data driver 550 may generate the data voltages VD based on output image data ODAT and a data control signal DCTRL received from the controller 570, and may provide the data voltages VD to the plurality of pixels through the plurality of data lines. In some embodiments, the output image data ODAT may include a plurality of line data LDAT for a plurality of pixel lines (or a plurality of pixel rows) of the display panel 510. Further, in some embodiments, the data control signal DCTRL may include, but not limited to, a data clock signal DCLK and a load signal LOAD illustrated in FIG. 1. Further, in some embodiments, the data driver 550 may be a data driver 100 of FIG. 1, or the like.

The data driver 550 may store a pixel arrangement option PAO representing a pixel arrangement structure of the display panel 510 and may perform an operation suitable for the pixel arrangement structure of the display panel 510 according to the pixel arrangement option PAO. In some embodiments, the data driver 550 may include a digital-to-analog converting block that converts the line data LDAT into the data voltages DV, an option storing block that stores the pixel arrangement option PAO representing the pixel arrangement structure of the display panel 510, a data swap block that selectively performs a data swap operation that swaps the data voltages DV based on the pixel arrangement option PAO and whether the line data LDAT are odd line data or even line data, and an output buffer block that outputs the data voltages DV on which the data swap operation is selectively performed to the plurality of data lines. Accordingly, the data driver 550 may drive various display panels having different pixel arrangement structures.

In some embodiments, the data driver 550 may be mounted on a substrate of the display panel 510 in a chip on glass (COG) manner or a chip on plastic (COP) manner. In other embodiments, the data driver 550 may be mounted on a flexible film coupled to the display panel 510 in a chip on film (COF) manner. Further, in some embodiments, the data driver 500 may be implemented in a form of an integrated circuit. For example, the data driver 550 and the controller 570 may be implemented with a single integrated circuit, and the single integrated circuit may be referred to as a timing controller embedded data driver (TED).

The controller 570 (e.g., a timing controller (TCON)) may receive input image data IDAT and a control signal CTRL from an external host processor (e.g., an application processor (AP), a graphics processing unit (GPU), a graphics card, etc.). For example, the input image data IDAT may be, but not limited to, RGB data including red pixel data, green pixel data and blue pixel data. In some embodiments, in a case where the display panel 510 is an RGBG PENTILE™ display panel, the controller 570 may generate the output image data ODAT by converting the RGB data for an entire display region of the display panel 510 into RGBG data. In other embodiments, in a case where the display panel 510 is a hybrid display panel including a first display region that is an RGBG PENTILE™ region and a second display region that is an RGB stripe region, the controller 570 may generate the output image data ODAT by converting the RGB data for the first display region of the display panel 510 into RGBG data and by not converting the RGB data for the second display region of the display panel 510. Further, in some embodiments, the control signal CTRL may include, but not limited to, a data enable signal, a master clock signal, etc. The controller 570 may control an operation of the scan driver 530 by providing the scan control signal SCTRL to the scan driver 530, and may control an operation of the data driver 550 by providing the output image data ODAT and the data control signal DCTRL to the data driver 550.

As described above, in the display device 500 according to embodiments, the data driver 550 may store the pixel arrangement option PAO representing the pixel arrangement structure of the display panel 510, and may selectively perform the data swap operation according to the pixel arrangement option PAO. Thus, in the display device 500 according to embodiments, the data driver 550 may drive the display panel 510 that is any one of various display panels having different pixel arrangement structures.

Figure 14:
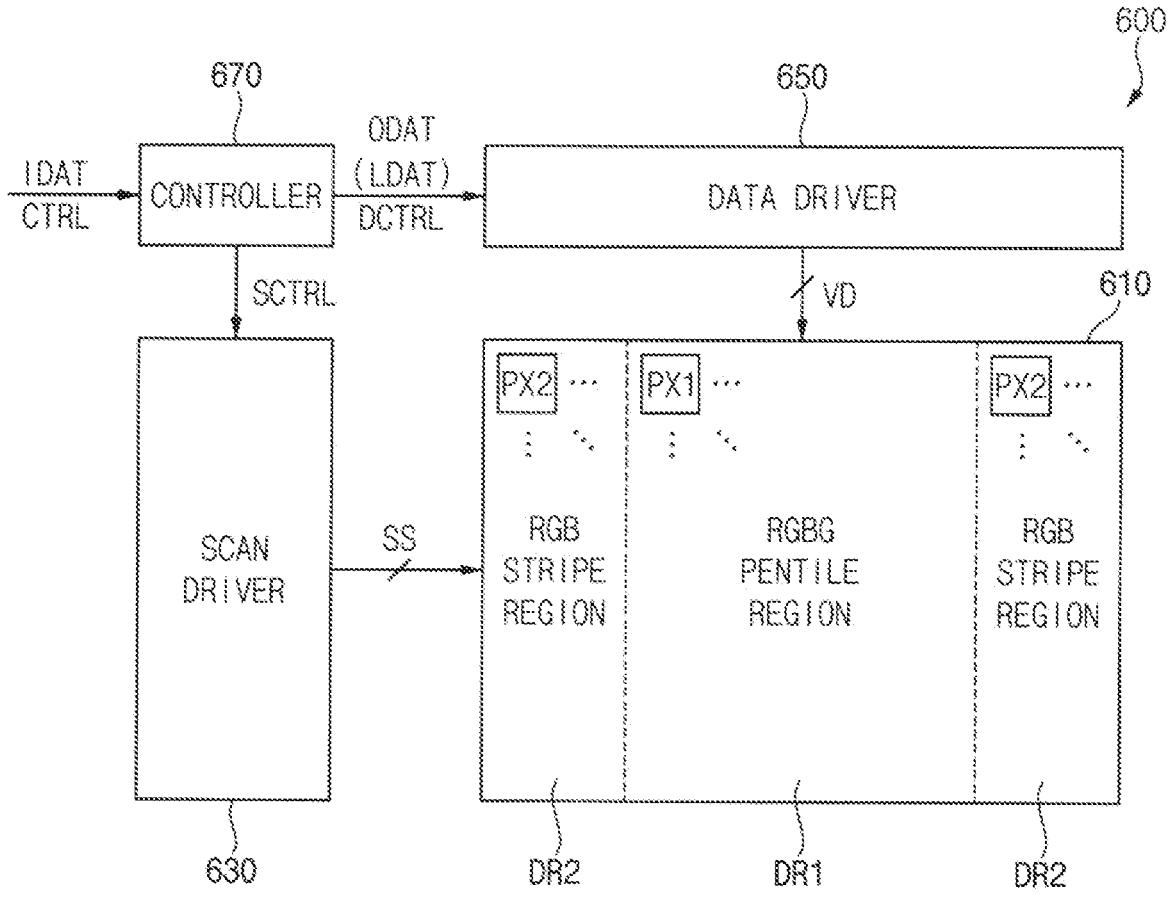
FIG. 14 is a block diagram illustrating a display device including a data driver according to embodiments.

FIG. 14 is a block diagram illustrating a display device including a data driver according to embodiments.

Referring to FIG. 14, a display device 600 according to embodiments may include a display panel 610, a scan driver 630, a data driver 650 and a controller 670.

The display panel 610 may include a first display region DR1 in which first pixels PX1 are arranged in a first pixel arrangement structure (e.g., an RGBG PENTILE™ pixel arrangement structure) and a second display region DR2 in which second pixels PX2 are arranged in a second pixel arrangement structure (e.g., an RGB stripe pixel arrangement structure) different from the first pixel arrangement structure. For example, as illustrated in FIG. 14, the first display region DR1 may be an RGBG PENTILE™ region, and the second display region DR2 may be an RGB stripe region. Further, in some embodiments, the first display region DR1 may be a center region disposed at a center of the display panel 610, and the second display region DR2 may be a POD region disposed at both sides of the display panel 610. In other embodiments, as illustrated in FIG. 10, the first display region DR1 may be a center region NPR disposed at a center of the display panel 610, and the second display region DR2 may include a POD region PODR disposed at both sides of the display panel 610 and a corner region CR disposed at four corners of the display panel 610.

The data driver 650 may perform a data swap operation that swaps data voltages DV for the first display region DR1 and may not perform the data swap operation for the second display region DR2. In some embodiments, the data swap operation may be an even line data swap operation that swaps the data voltage DV at a (4N+1)-th data channel and the data voltage DV at a (4N+3)-th data channel with each other among the data voltages DV corresponding to even line data, where N is an integer greater than or equal to 0. Accordingly, the data driver 650 may drive the hybrid display panel 610 having both of the RGBG PENTILE™ pixel arrangement structure and the RGB stripe pixel arrangement structure.

Figure 15:
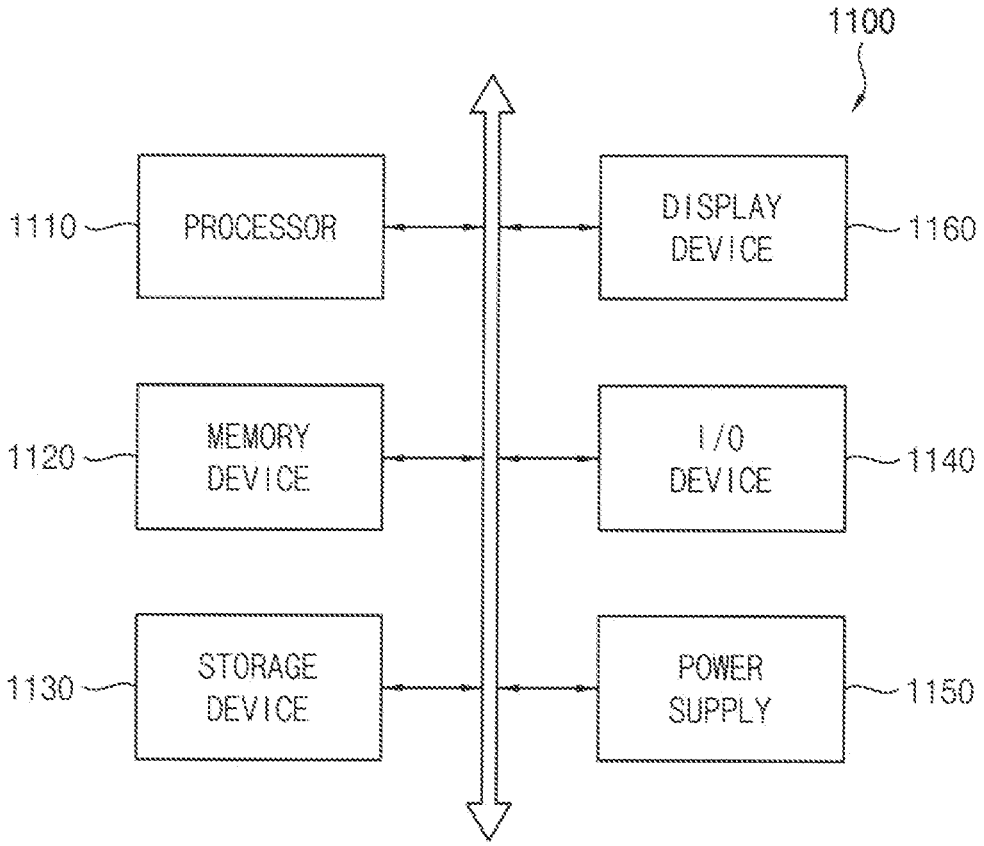
FIG. 15 is a block diagram illustrating an electronic device including a display device according to embodiments.

FIG. 15 is a block diagram illustrating an electronic device including a display device according to embodiments.

Referring to FIG. 15, an electronic device 1100 may include a processor 1110, a memory device 1120, a storage device 1130, an input/output (I/O) device 1140, a power supply 1150, and a display device 1160. The electronic device 1100 may further include a plurality of ports for communicating with a video card, a sound card, a memory card, a universal serial bus (USB) device, other electric devices, etc.

The processor 1110 may perform various computing functions or tasks. The processor 1110 may be an application processor (AP), a micro processor, a central processing unit (CPU), etc. The processor 1110 may be coupled to other components via an address bus, a control bus, a data bus, etc. Further, in some embodiments, the processor 1110 may be further coupled to an extended bus such as a peripheral component interconnection (PCI) bus.

The memory device 1120 may store data for operations of the electronic device 1100. For example, the memory device 1120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile dynamic random access memory (mobile DRAM) device, etc.

The storage device 1130 may be a solid state drive (SSD) device, a hard disk drive (HDD) device, a CD-ROM device, etc. The I/O device 1140 may be an input device such as a keyboard, a keypad, a mouse, a touch screen, etc, and an output device such as a printer, a speaker, etc. The power supply 1150 may supply power for operations of the electronic device 1100. The display device 1160 may be coupled to other components via the buses or other communication links.

In the display device 1160, a data driver may store a pixel arrangement option representing a pixel arrangement structure of a display panel, and may selectively perform a data swap operation that swaps data voltages according to the pixel arrangement option. Thus, in the display device 1160, the data driver may drive the display panel that is any one of various display panels having different pixel arrangement structures. In particular, in the display device 1160, the data driver may drive a hybrid display panel having both of an RGBG PENTILE™ pixel arrangement structure and an RGB stripe pixel arrangement structure.

According to embodiments, the electronic device 1100 may be any electronic device including the display device 1160, such as a digital television, a 3D television, a personal computer (PC), a home appliance, a laptop computer, a cellular phone, a smart phone, a tablet computer, a wearable device, a personal digital assistant (PDA), a portable multimedia player (PMP), a digital camera, a music player, a portable game console, a navigation system, etc.

The foregoing is illustrative of embodiments and is not to be construed as limiting thereof. Although a few embodiments have been described, those skilled in the art will readily appreciate that many modifications are possible in the embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various embodiments and is not to be construed as limited to the specific embodiments disclosed, and that modifications to the disclosed embodiments, as well as other embodiments, are intended to be included within the scope of the appended claims.

What is claimed is:

1. A data driver for providing data voltages to a display panel, the data driver comprising:

a digital-to-analog converting block converting line data into the data voltages;

an option storing block storing a pixel arrangement option representing a pixel arrangement structure of the display panel;

a data swap block connected to the digital-to-analog converting block and the option storing block, and selectively performing a data swap operation that swaps the data voltages based on the pixel arrangement option and whether the line data are odd line data or even line data; and an output buffer block connected to the data swap block and outputting the data voltages on which the data swap operation is selectively performed to data lines, wherein the data swap operation is exclusively performed on odd numbered pixel rows or even numbered pixel rows.

2. The data driver of claim 1, wherein, in a case where the pixel arrangement option has a first value, and the line data are the even line data, the data swap block performs the data swap operation for an entire display region of the display panel, and wherein, in a case where the pixel arrangement option has a second value, and the line data are the even line data, the data swap block performs the data swap operation for a first display region of the display panel and does not perform the data swap operation for a second display region of the display panel.

3. The data driver of claim 2, wherein the first display region is an RGBG PENTILE™ region and the second display region is an RGB stripe region.

4. The data driver of claim 2, wherein the first display region is a center region disposed at a center of the display panel and the second display region is a pixel on driver (POD) region disposed at both sides of the display panel.

5. The data driver of claim 2, wherein the first display region is a center region disposed at a center of the display panel and the second display region includes a pixel on driver (POD) region disposed at both sides of the display panel and a corner region disposed at four vertices of the display panel.

6. The data driver of claim 1, wherein the data swap operation is an even line data swap operation that swaps odd numbered data voltages adjacent each other in the even line data, where N is an integer greater than or equal to 0.

7. The data driver of claim 1, wherein the data swap block includes:

a switch block disposed between the digital-to-analog converting block and the output buffer block; and a switch control block connected to the switch block and the option storing block, and controlling the switch block based on the pixel arrangement option and whether the line data are the odd line data or the even line data.

8. The data driver of claim 7, wherein the digital-to-analog converting block includes a plurality of digital-to-analog converters, wherein the output buffer block includes a plurality of output buffers, wherein even numbered digital-to-analog converters of the plurality of digital-to-analog converters are directly coupled to even numbered output buffers of the plurality of output buffers, respectively, where N is an integer greater than or equal to 0, and wherein the switch block includes:

first switches respectively coupling odd numbered digital-to-analog converters of the plurality of digital-to-analog converters to odd numbered output buffers of the plurality of output buffers in response to first switching signals; and second switches coupling each of the odd numbered digital-to-analog converters to an odd numbered output buffer disposed adjacent to a column in which the each of the odd numbered digital-to-analog converters are disposed in response to second switching signals.

9. The data driver of claim 8, wherein, in a case where the pixel arrangement option has a first value and the line data are the odd line data, the switch control block provides the first switching signals to all of the first switches corresponding to an entire display region of the display panel, and wherein, in a case where the pixel arrangement option has the first value and the line data are the even line data, the switch control block provides the second switching signals to all of the second switches corresponding to the entire display region of the display panel.

10. The data driver of claim 8, wherein, in a case where the pixel arrangement option has a second value and the line data are the odd line data, the switch control block provides the first switching signals to all of the first switches corresponding to an entire display region of the display panel, and wherein, in a case where the pixel arrangement option has the second value and the line data are the even line data, the switch control block provides the second switching signals to a portion of the second switches corresponding to a first display region of the display panel and provides the first switching signals to a portion of the first switches corresponding to a second display region of the display panel.

11. The data driver of claim 1, wherein the pixel arrangement option has two or more bits to represent one of three or more pixel arrangement structures.

12. The data driver of claim 11, wherein the pixel arrangement option having a first value represents that an entire display region of the display panel is an RGBG PENTILE™ region, wherein the pixel arrangement option having a second value represents that a first center region disposed at a center of the display panel is the RGBG PENTILE™ region and a first POD region disposed at both sides of the display panel and corresponding to a first number of data channels is an RGB stripe region, wherein the pixel arrangement option having a third value represents that a second center region disposed at the center of the display panel is the RGBG PENTILE™ region and a second POD region disposed at the both sides of the display panel and corresponding to a second number of data channels is the RGB stripe region, and wherein the pixel arrangement option having a fourth value represents that a third center region disposed at the center of the display panel is the RGBG PENTILE™ region and a third POD region disposed at the both sides of the display panel and a corner region disposed at four corners of the display panel is the RGB stripe region.

13. The data driver of claim 1, further comprising:

a shift register sequentially generating sampling signals;

a sampling latch block sequentially storing the line data in response to the sampling signals; and a holding latch block receiving the line data from the sampling latch block in response to a load signal and to provide the line data to the digital-to-analog converting block.

14. A display device comprising:

a display panel;

a scan driver providing scan signals to the display panel;

a data driver providing data voltages to the display panel; and a controller controlling the scan driver and the data driver, wherein the data driver includes:

a digital-to-analog converting block converting line data into the data voltages;

an option storing block storing a pixel arrangement option representing a pixel arrangement structure of the display panel;

a data swap block connected to the digital-to-analog converting block and the option storing block, and selectively performing a data swap operation that swaps the data voltages based on the pixel arrangement option and whether the line data are odd line data or even line data; and an output buffer block connected to the data swap block and outputting the data voltages on which the data swap operation is selectively performed to data lines, wherein the data swap operation is exclusively performed on odd numbered pixel rows or even numbered pixel rows.

15. The display device of claim 14, wherein, in a case where the pixel arrangement option has a first value and the line data are the even line data, the data swap block performs the data swap operation for an entire display region of the display panel, and wherein, in a case where the pixel arrangement option has a second value, and the line data are the even line data, the data swap block performs the data swap operation for a first display region of the display panel and does not perform the data swap operation for a second display region of the display panel.

16. A data driver for providing data voltages to a display panel which includes a plurality of columns, the data driver comprising:

a digital-to-analog converting block including a plurality of digital-to-analog converters each disposed in a column, respectively;

an option storing block storing a pixel arrangement option representing a pixel arrangement structure of the display panel;

a data swap block connected to the digital-to-analog converting block and the option storing block; and an output buffer block connected to the data swap block and outputting the data voltages, the output buffer block including a plurality of output buffers each disposed in a respective column, wherein the data swap block includes:

a plurality of first switches, each of the plurality of first switches connecting one of the plurality of digital-to-analog converters to one of the plurality of output buffers disposed in a same column, and a plurality of second switches, each of the plurality of second switches connecting one of the plurality of digital-to-analog converters disposed in one of odd columns or even columns to one of the plurality of output buffers disposed in the one of the odd columns or the even columns different from the column to which the one of the plurality of digital-to-analog converters is connected, and wherein the plurality of first switches receive a first switching signal and the plurality of second switches receive a second switching signal different from the first switching signal.

17. The display device of claim 16, wherein the each of the plurality of second switches connects one digital-to-analog converter in one even column to one output buffer disposed in another even column.

18. The display device of claim 17, wherein the each of the plurality of second switches connects the one digital-to-analog converter in the one even column to the one output buffer disposed in an even column disposed adjacent the one even column.

19. The display device of claim 16, wherein the each of the plurality of second switches connects one digital-to-analog converter in one odd column to one output buffer disposed in another odd column.

20. The display device of claim 19, wherein the each of the plurality of second switches connects the one digital-to-analog converter in the one odd column to the one output buffer disposed in an odd column disposed adjacent the one odd column.

* * * * *